US011185856B2

(12) United States Patent
Motadel et al.

(10) Patent No.: US 11,185,856 B2
(45) Date of Patent: Nov. 30, 2021

(54) PIPETTE TIP

(71) Applicant: Biotix, Inc., San Diego, CA (US)

(72) Inventors: Arta Motadel, San Diego, CA (US); Peter Paul Blasczak, San Diego, CA (US)

(73) Assignee: BIOTIX, INC., San Diego, CA (US)

( * ) Notice: Subject to any disclaimer, the term of this patent is extended or adjusted under 35 U.S.C. 154(b) by 189 days.

(21) Appl. No.: 16/396,101

(22) Filed: Apr. 26, 2019

(65) Prior Publication Data

US 2019/0344258 A1 Nov. 14, 2019

Related U.S. Application Data

(60) Provisional application No. 62/724,308, filed on Aug. 29, 2018, provisional application No. 62/670,361, filed on May 11, 2018.

(51) Int. Cl.
*B01L 3/02* (2006.01)

(52) U.S. Cl.
CPC ..... *B01L 3/0275* (2013.01); *B01L 3/0279* (2013.01); *B01L 2200/025* (2013.01); *B01L 2200/026* (2013.01); *B01L 2300/0681* (2013.01); *B01L 2300/0858* (2013.01)

(58) Field of Classification Search
None
See application file for complete search history.

(56) References Cited

U.S. PATENT DOCUMENTS

| | | | | |
|---|---|---|---|---|
| D255,601 | S | 6/1980 | De Vaughn | |
| 4,707,337 | A | 11/1987 | Jeffs | |
| 5,156,811 | A | 10/1992 | White | |
| D335,348 | S | 5/1993 | Frenkel | |
| 5,487,997 | A * | 1/1996 | Stolp | B01L 9/543 206/443 |
| D414,562 | S | 9/1999 | Tajima | |
| D438,981 | S | 3/2001 | Rainin | |
| 6,197,258 | B1 | 3/2001 | Thompson et al. | |
| 6,197,259 | B1 | 3/2001 | Kelly et al. | |
| D448,853 | S | 10/2001 | Rainin | |
| D461,904 | S | 8/2002 | Petrek | |
| 6,566,145 | B2 | 5/2003 | Brewer | |
| D487,593 | S | 3/2004 | Sarna | |
| D559,396 | S | 1/2008 | Dave | |
| 7,335,337 | B1 | 2/2008 | Smith | |
| D663,042 | S | 7/2012 | Motadel | |

(Continued)

FOREIGN PATENT DOCUMENTS

| | | |
|---|---|---|
| EP | 2 138 234 | 12/2009 |
| EP | 3 358 334 A1 | 8/2018 |

(Continued)

OTHER PUBLICATIONS

International Preliminary Report on Patentability dated Nov. 26, 2020 in International Patent Application No. PCT/US2019/029386, filed on Apr. 26, 2019, 13 pages.

(Continued)

*Primary Examiner* — Jill A Warden
*Assistant Examiner* — Brittany I Fisher
(74) *Attorney, Agent, or Firm* — Grant IP, Inc.

(57) ABSTRACT

Disclosed here are pipette tips useful for receiving and dispensing liquids, which include a plurality of beveled interior ribs.

24 Claims, 19 Drawing Sheets

(56) References Cited

U.S. PATENT DOCUMENTS

| | | | | |
|---|---|---|---|---|
| D680,226 | S | 4/2013 | Motadel | |
| D847,367 | S | 4/2019 | Trump | |
| D905,865 | S | 12/2020 | Motadel | |
| 2007/0017870 | A1 | 1/2007 | Belov et al. | |
| 2008/0095665 | A1 | 4/2008 | Smith | |
| 2010/0218622 | A1 | 9/2010 | Motadel | |
| 2011/0076205 | A1* | 3/2011 | Kelly | B01L 3/0279 422/525 |
| 2011/0183433 | A1 | 7/2011 | Motadel et al. | |
| 2012/0071643 | A1* | 3/2012 | Helfer | C12N 15/1003 536/25.4 |
| 2013/0164194 | A1* | 6/2013 | Motadel | B01L 3/0275 422/525 |
| 2013/0213151 | A1* | 8/2013 | Beese | B01L 3/0279 73/864.01 |

FOREIGN PATENT DOCUMENTS

| | | |
|---|---|---|
| FR | 171442 | 4/1978 |
| JP | 2006-521909 | 9/2006 |
| JP | 2013-136052 | 7/2013 |
| JP | 2017-067481 | 4/2017 |
| JP | 2018-012085 | 1/2018 |
| WO | WO 2003/095980 A1 | 11/2003 |
| WO | WO 2010/008737 | 1/2010 |
| WO | WO 2010/054337 | 5/2010 |
| WO | WO 2011/091308 | 7/2011 |
| WO | WO 2016/094553 | 6/2016 |
| WO | WO 2019/217098 A1 | 11/2019 |

OTHER PUBLICATIONS

International Search Report and Written Opinion dated Jun. 14, 2019 in International Application No. PCT/US2019/029386, filed on Apr. 26, 2019.

How to Choose the Right Pipette Tips for your Experiment. Online, published date Sep. 27, 2016. Retrieved on Aug. 4, 2019 from URL: https://biotix.com/resources/blog/how-to-choose-the-right-pipette-tips-for-your-experiment/.

Pipette Tips for Gilson® Pipetman® and other Pipettors. Online, published date unknown. Retrieved on Aug. 4, 2019 from URL: https://www.krinslifescienceslab.ca/product/gilson-pipetman/.

"Office Action dated Dec. 6, 2019 in U.S. Appl. No. 29/647,343, filed May 11, 2018", 8 pages.

"Office Action dated May 8, 2020 in U.S. Appl. No. 29/647,343, filed May 11, 2018", 7 pages.

Office Action dated Aug. 20, 2020 in U.S. Appl. No. 29/647,343, filed May 11, 2018, 5 pages.

* cited by examiner

PIPETTE TIP

RELATED PATENT APPLICATIONS

This patent application claims the benefit of (i) U.S. provisional patent application No. 62/724,308 filed on Aug. 29, 2018, entitled PIPETTE TIP, naming Arta Motadel et al. as inventors; and (ii) U.S. provisional patent application No. 62/670,361 filed on May 11, 2018, entitled PIPETTE TIP, naming Arta Motadel et al. as inventors. The entire content of each of the foregoing patent applications is herein incorporated by reference for all purposes, including all text, tables and drawings.

FIELD

The technology relates in part to pipette tips, methods of manufacture and methods of use.

BACKGROUND

Pipette tips are utilized in a variety of industries that have a requirement for handling fluids, and are used in facilities including medical laboratories and research laboratories, for example. In many instances pipette tips are used in large numbers, and often are utilized for processing many samples and/or adding many reagents to samples, for example.

Pipette tips often are substantially cone-shaped with an aperture at one end that can engage a dispensing device, and another relatively smaller aperture at the other end that can receive and emit fluid. Pipette tips generally are manufactured from a moldable plastic, such as polypropylene, for example. Pipette tips are made in a number of sizes to allow for accurate and reproducible liquid handling for volumes ranging from nanoliters to milliliters.

Pipette tips can be utilized in conjunction with a variety of dispensing devices, including manual dispensers (e.g., pipettors) and automated dispensers. A dispenser, when attached to the upper, proximal end of a pipette tip (the larger opening end), applies negative pressure (e.g., negative air pressure) to acquire fluids, and applies positive pressure (e.g., positive air pressure) to dispense fluids. The lower, distal portion of a dispenser (typically referred to as the barrel or nozzle) is placed in contact with the proximal end of the pipette tip and held in place by inserting and pressing the barrel or nozzle of the dispenser into the proximal portion of the pipette tip. The combination then can be used to manipulate liquid samples, where fluid generally is received and emitted through the lower, distal opening of a pipette tip engaged with a dispenser. A pipette tip can be removed or ejected from a dispenser after fluid is received and optionally emitted by the pipette tip.

SUMMARY

Provided in an aspect is a pipette tip that includes a proximal opening, a distal opening, a proximal region, a distal region, an exterior surface, an interior surface, and a plurality of interior ribs. The proximal opening generally is located at the proximal terminus of the pipette tip and the distal opening typically is located at the distal terminus of the pipette tip. Each interior rib of the plurality of interior ribs often is axially disposed on the interior surface of the pipette tip in the proximal region, the interior ribs of the plurality of interior ribs often are circumferentially distributed around the interior surface of the pipette tip, and each interior rib of the plurality of interior ribs often includes an axial surface facing the pipette tip interior and an adjoining proximal surface. The proximal surface of each of the interior ribs often is disposed at an angle between 10 degrees and 80 degrees relative to a virtual longitudinal axis disposed at, and extending through, the center of the pipette tip interior.

A pipette tip generally includes a length between the proximal opening and the distal opening, the proximal region typically includes a proximal region length, the distal region generally includes a distal region length, and the proximal region typically adjoins the distal region. The proximal region length sometimes is about 45% or less of the length between the proximal opening and the distal opening.

A pipette tip sometimes includes a plurality of exterior ribs. Each exterior rib of the plurality of exterior ribs often is axially disposed on the exterior surface of the pipette tip, the exterior ribs of the plurality of exterior ribs often are circumferentially distributed around the exterior surface of the pipette tip, and each exterior rib of the plurality of exterior ribs generally includes a distal terminus. The proximal region of the pipette tip sometimes extends from the proximal opening of the pipette tip to the distal terminus of the exterior ribs. The distal region of the pipette tip sometimes extends from the distal opening to at least a subset of the distal terminus of the exterior ribs (e.g., the distal terminus of the exterior ribs sometimes are disposed the same distance from the proximal opening of the pipette tip).

Provided also in an aspect is a method for manufacturing a pipette tip, that includes: (a) dispensing a molten polymer into a cavity of a mold configured to mold a pipette tip described herein, (b) permitting the polymer in the cavity to cool, and (c) releasing the formed pipette tip from the mold after cooling. Also provided in an aspect is a method for using a pipette tip, that includes: (a) inserting a fluid dispenser member into a pipette tip described herein, and (b) receiving fluid into the pipette tip.

Certain embodiments are described further in the following description, examples, claims and drawings.

BRIEF DESCRIPTION OF THE DRAWINGS

The drawings illustrate embodiments of the disclosed technology and are not limiting. For clarity and ease of illustration, the drawings are not necessarily made to scale and, in some instances, various aspects may be shown exaggerated or enlarged to facilitate an understanding of particular embodiments.

Figure 1:
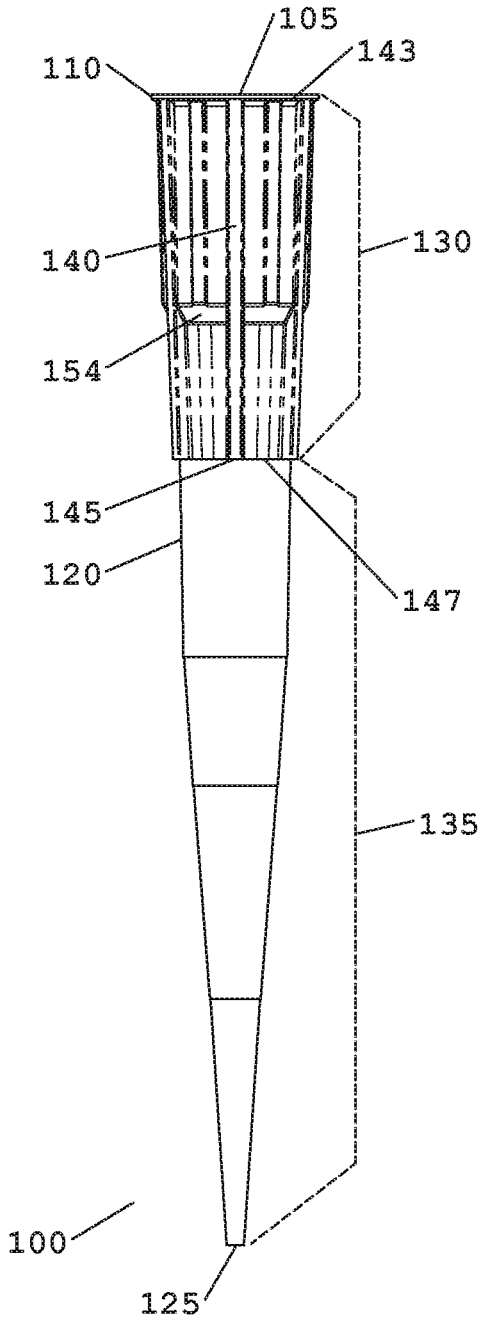
FIG. 1 shows a front view of pipette tip embodiment 100 that includes exterior ribs and interior ribs.
Figure 2:
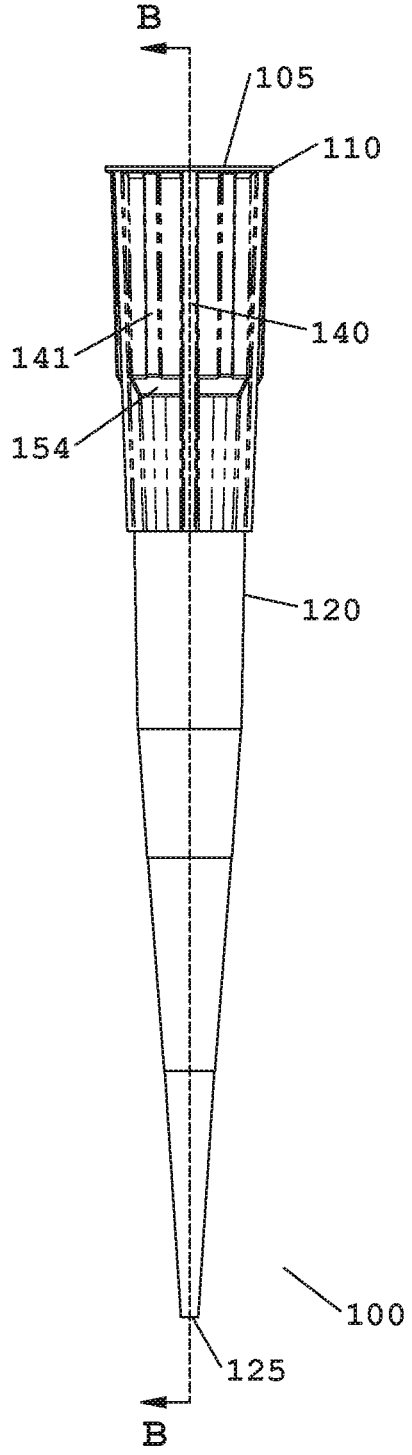
FIG. 2 is a rear view thereof.
Figure 3:
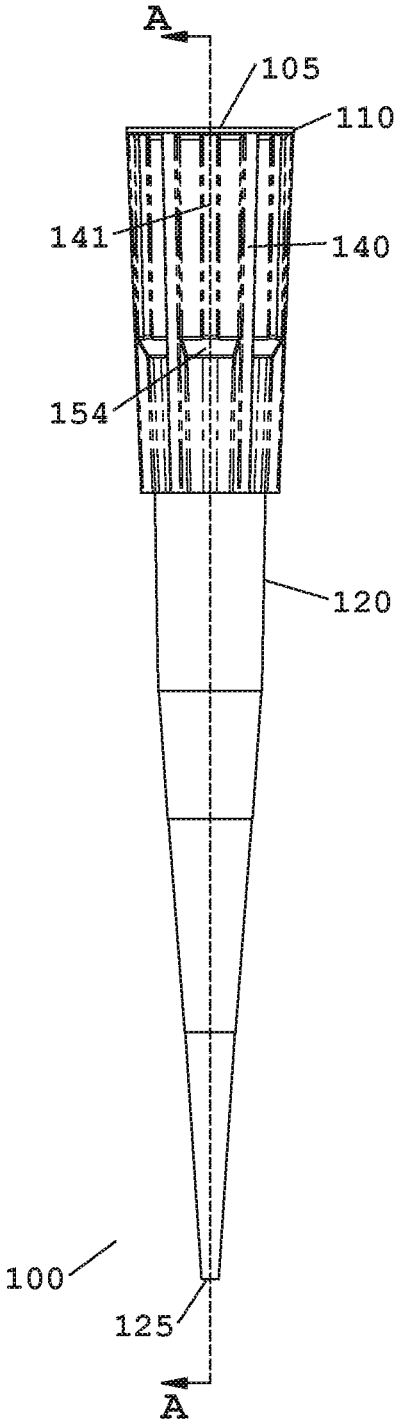
FIG. 3 is a side view thereof.
Figure 4:
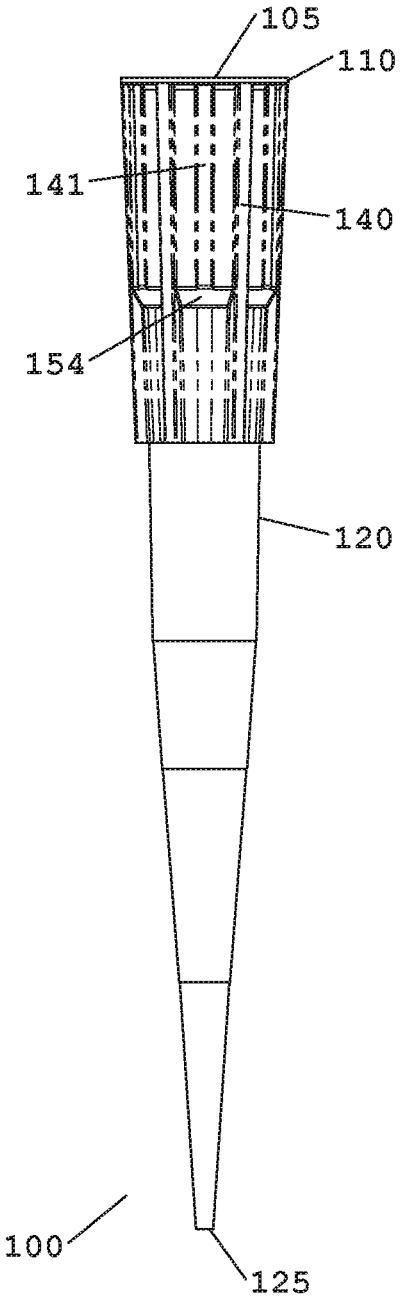
FIG. 4 is an opposing side view thereof.

Certain features in the drawings are summarized in Table 1.

TABLE 1

| Callout | Element(s) |
|---|---|
| 100 | pipette tip |
| 105 | proximal terminus |
| 107 | proximal opening |
| 110 | flange |
| 112 | flange distal perimeter on interior surface |
| 113 | flange underside on exterior surface |
| 115 | interior surface |
| 120 | exterior surface |
| 125 | distal terminus |
| 127 | distal opening |
| 128 | region of reduced thickness |
| 130 | proximal region |
| 135 | distal region |
| 140 | exterior rib |
| 141 | exterior rib |
| 143 | exterior rib proximal terminus |
| 145 | exterior rib distal terminus |
| 147 | collar |
| 150 | first interior wall section |
| 151 | axial length of first interior wall section |
| 153 | second interior wall section |
| 154 | exterior wall section opposite second interior wall section |
| 155 | interior rib |
| 157 | distance between (i) interior rib proximal terminus 160 and (ii) flange distal perimeter 112 |
| 158 | distance between (i) interior rib proximal terminus 160 and (ii) pipette tip proximal terminus 105 |
| 160 | interior rib proximal terminus |
| 163 | interior rib proximal surface |
| 165 | interior rib axial surface |
| 166 | interior rib side surface |
| 167 | interior rib distal terminus |
| 168 | beveled transition between interior rib proximal surface and interior rib axial surface |
| 169 | beveled transition between interior rib proximal surface and interior rib side surface |
| 170 | filter |
| 173 | filter distal surface |
| 175 | filter proximal surface |
| 180 | exterior wall section between exterior ribs |
| 185 | interior wall section between interior ribs |
| 190 | sealing zone |
| 192 | junction between nozzle distal terminus and interior rib proximal terminus |
| 195 | longitudinal axis |
| 196 | axis collinear with interior rib proximal surface |
| 197 | axis collinear with second interior wall section surface |
| angle a | angle (e.g., draft angle) between axis 195 and axis 196 |
| angle b | angle (e.g., draft angle) between axis 195 and axis 197 |
| 200 | fluid dispenser |
| 205 | ejector |
| 210 | nozzle |
| 212 | nozzle exterior surface |

TABLE 1-continued

| Callout | Element(s) |
|---|---|
| 215 | channel |
| 220 | nozzle distal terminus |
| 250 | assembly that includes pipette tip 100 and dispenser 200 |
| 300 | pipette tip |
| 305 | proximal terminus |
| 310 | flange |
| 315 | interior surface |
| 320 | exterior surface |
| 325 | distal terminus |
| 330 | proximal region |
| 335 | distal region |
| 340 | exterior rib |
| 341 | exterior rib |
| 345 | exterior rib distal terminus |
| 350 | first interior wall section |
| 353 | second interior wall section |
| 354 | exterior wall section opposite second interior wall section |
| 355 | interior rib |
| 360 | interior rib proximal terminus |
| 363 | interior rib proximal surface |
| 365 | interior rib axial surface |
| 370 | filter |
| 375 | filter proximal surface |
| 380 | exterior wall section between exterior ribs |
| 385 | interior wall section between interior ribs |
| 395 | frustum-shaped cavity |
| 400 | pipette tip |
| 405 | proximal terminus |
| 410 | flange |
| 415 | interior surface |
| 420 | exterior surface |
| 425 | distal terminus |
| 430 | proximal region |
| 435 | distal region |
| 440 | exterior rib |
| 441 | exterior rib |
| 445 | exterior rib distal terminus |
| 450 | first interior wall section |
| 453 | second interior wall section |
| 454 | exterior wall section opposite second interior wall section |
| 455 | interior rib |
| 460 | interior rib proximal terminus |
| 463 | interior rib proximal surface |
| 465 | interior rib axial surface |
| 470 | filter |
| 475 | filter proximal surface |
| 480 | exterior wall section between exterior ribs |
| 485 | interior wall section between interior ribs |
| 500 | pipette tip |
| 505 | proximal terminus |
| 510 | flange |
| 515 | interior surface |
| 520 | exterior surface |
| 525 | distal terminus |
| 530 | proximal region |
| 535 | distal region |
| 540 | exterior rib |
| 541 | exterior rib |
| 545 | exterior rib distal terminus |
| 550 | first interior wall section |
| 553 | second interior wall section |
| 554 | exterior wall section opposite second interior wall section |
| 555 | interior rib |
| 560 | interior rib proximal terminus |
| 563 | interior rib proximal surface |
| 565 | interior rib axial surface |
| 570 | filter |
| 575 | filter proximal surface |
| 580 | exterior wall section between exterior ribs |
| 585 | interior wall section between interior ribs |
| 600 | pipette tip |
| 605 | proximal terminus |
| 610 | flange |
| 615 | interior surface |
| 620 | exterior surface |

TABLE 1-continued

| Callout | Element(s) |
|---|---|
| 625 | distal terminus |
| 630 | proximal region |
| 635 | distal region |
| 640 | exterior rib |
| 641 | exterior rib |
| 645 | exterior rib distal terminus |
| 650 | first interior wall section |
| 653 | second interior wall section |
| 654 | exterior wall section opposite second interior wall section |
| 655 | interior rib |
| 660 | interior rib proximal terminus |
| 663 | interior rib proximal surface |
| 665 | interior rib axial surface |
| 670 | filter |
| 675 | filter proximal surface |
| 680 | exterior wall section between exterior ribs |
| 685 | interior wall section between interior ribs |

DETAILED DESCRIPTION

Provided herein is a pipette tip that includes a plurality of interior ribs, where each interior rib is axially disposed on an interior surface of a proximal region of the pipette tip, and where the plurality of interior ribs are circumferentially distributed around the interior surface of the pipette tip. Each of the interior ribs generally includes a proximal terminus, a proximal surface and an axial surface. The proximal surface of each of the interior ribs often is disposed at an angle between 10 degrees and 80 degrees relative to a virtual longitudinal axis disposed at, and traversing through, the center of the pipette tip interior. The angled proximal surface of each of the interior ribs can function to facilitate filter loading as part of a process for manufacturing pipette tips containing an internal filter. The proximal termini of the interior ribs together can function as a barrier to a distal terminus of a fluid dispenser nozzle inserted in a pipette tip interior, thereby limiting insertion depth of the nozzle into the pipette tip. The interior wall surface of a pipette tip between the proximal terminus of the pipette tip and the distal terminus of the interior ribs often does not include a protrusion (e.g., is free or substantially free of a protrusion; does not include an annular protrusion) and sometimes is smooth or substantially smooth. These and other aspects of certain pipette tip embodiments are described in greater detail hereafter.

Interior Ribs

In certain embodiments, a pipette tip includes a filter, and the angle of the proximal surface of each of the interior ribs, which is declined towards the distal portion of the pipette tip, facilitates insertion of the filter as part of a process for manufacturing such a pipette tip. In some embodiments, a pipette tip described herein can be loaded with a filter by a process that includes: disposing a filter at the proximal terminus of a pipette tip described herein and applying a force to the proximal surface of the filter. The force often is applied in a direction parallel to a virtual longitudinal axis disposed at, and traversing through, the center of the pipette tip interior, and the force often is applied collinearly with the longitudinal axis. The distal surface of the filter often contacts and passes over the proximal surface of the interior ribs, and the force often is applied until the proximal surface of the filter is disposed at a position distal to the distal terminus of each of the interior ribs. By way of comparison, if the proximal surface of the interior ribs extended perpendicularly or near perpendicularly from the interior sidewall, the proximal surface of such interior ribs would exert more friction on the distal surface and side surface of a filter and impede filter insertion, relative to pipette tips described herein having interior ribs with angled surfaces. In certain pipette tip embodiments, each of the interior ribs includes a distal terminus, the pipette tip includes a filter having a proximal surface and a distal surface, and the proximal surface of the filter is disposed at, or is distally spaced from, the distal terminus of the each of the interior ribs.

Interior ribs often are disposed on an interior surface located in the proximal region of a pipette tip. The proximal region (e.g., region 130 illustrated in FIG. 1) typically adjoins the distal region, and the proximal region length often is shorter than the distal region length. The proximal region length and the distal region length each generally is a percentage of a virtual longitudinal axis disposed at, and traversing through, the center of the pipette tip interior, between the proximal terminus and the distal terminus of the pipette tip. In certain embodiments, the proximal region length sometimes is about 45% or less of the length between the proximal terminus and the distal terminus of the pipette tip (e.g., 10% or less, 11% or less, 12% or less, 13% or less, 14% or less, 15% or less, 16% or less, 17% or less, 18% or less, 19% or less, 20% or less, 21% or less, 22% or less, 23% or less, 24% or less, 25% or less, 26% or less, 27% or less, 28% or less, 29% or less, 30% or less, 31% or less, 32% or less, 33% or less, 34% or less, 35% or less, 36% or less, 37% or less, 38% or less, 39% or less, 40% or less, 41% or less, 42% or less, 43% or less, 44% or less of the length between the proximal terminus and the distal terminus of the pipette tip). In some embodiments, the distal boundary of the proximal region is configured as a shoulder. A shoulder sometimes includes an annular distal surface that projects from the exterior surface of the pipette tip at an angle of about 90 degrees (e.g., about 81 degrees to about 99 degrees) relative to a virtual longitudinal axis disposed at, and traversing through, the center of the pipette tip interior. A shoulder sometimes is defined, at last in part, by the distal terminus of each exterior rib, for embodiments in which a pipette tip includes exterior ribs, where the distal terminus of each exterior rib projects from the exterior surface of the pipette tip at the distal terminus of the proximal region and projects beyond the proximal terminus of the distal region.

Each rib (e.g., interior rib, exterior rib) generally is axially disposed on a wall of a pipette tip. The major length of an axially disposed rib typically is parallel to a virtual longitudinal axis disposed at, and traversing through, the center of the pipette tip interior (e.g., axis 195). The plurality of ribs disposed on a pipette tip (e.g., plurality of interior ribs, plurality of exterior ribs) generally is circumferentially disposed on a wall of a pipette tip. One point on each of the interior ribs in the plurality of interior ribs disposed on a pipette tip typically is disposed at a different location on one virtual circumference disposed on the interior wall of the pipette tip. Similarly, one point on each of the exterior ribs in the plurality of exterior ribs disposed on a pipette tip typically is disposed at a different location on one virtual circumference disposed on the exterior wall of the pipette tip.

In addition to the interior ribs facilitating filter loading into a pipette tip, the proximal termini of the interior ribs together can function as a barrier to a distal terminus of a fluid dispenser nozzle inserted in a pipette tip interior, thereby limiting insertion depth of the dispenser nozzle into the pipette tip. The nozzle distal terminus sometimes is in contact with the proximal terminus of interior ribs in a pipette tip (e.g., for a nozzle having a nozzle sidewall to nozzle distal terminus edge transition). The nozzle distal terminus sometimes is in contact with a proximal surface of interior ribs in a pipette tip at a point on the proximal surface spaced from the interior surface of the pipette tip (e.g., for a nozzle having a nozzle sidewall to nozzle distal terminus beveled or curved transition). A pipette tip can include any suitable number of interior ribs for functioning as a barrier to a distal terminus of a fluid dispenser inserted into the pipette tip. In some embodiments, a pipette tip includes about 3 to about 20 interior ribs (e.g., 3, 4, 5, 6, 7, 8, 9, 10, 11, 12, 13, 14, 15, 16, 17, 18, 19, 20 interior ribs in a pipette tip).

The angle of the proximal surface of interior ribs relative to the longitudinal axis is any angle suitable for facilitating filter loading and permitting the interior ribs to serve as barrier to a fluid dispenser distal terminus. The proximal surface of each of the interior ribs of a pipette tip sometimes is disposed at an angle of about 10 degrees to about 80 degrees relative to a virtual longitudinal axis disposed at, and traversing through, the center of the pipette tip interior (e.g., about 20 degrees to about 70 degrees, about 25 degrees to about 65 degrees, about 30 degrees to about 60 degrees, about 20 degrees to about 40 degrees, about 25 degrees to about 35 degrees about 35 degrees to about 55 degrees, about 40 degrees to about 50 degrees, about 50 degrees to about 70 degrees, about 55 degrees to about 65 degrees (e.g., about 20, 25, 26, 27, 28, 29, 30, 31, 32, 33, 34, 35, 40, 41, 42, 43, 44, 45, 46, 47, 48, 49, 50, 55, 56, 57, 58, 59, 60, 61, 62, 63, 64, 65, 70 degrees). An interior rib proximal surface is more steeply declined towards the distal region of a pipette tip when the angle is lower and an interior rib proximal surface is less steeply declined towards the distal region of a pipette tip when the angle is larger.

The distance between the proximal terminus of a pipette tip and the proximal terminus of an interior rib (e.g., vertical distance 158 shown in FIG. 9 for pipette tip 100) is any suitable distance and sometimes is about 0.15 inches to about 0.35 inches, about 0.20 inches to about 0.30 inches, about 0.20 to about 0.25 inches, or about 0.25 to about 0.30 inches (e.g., about 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35 inches).

Figure 10:
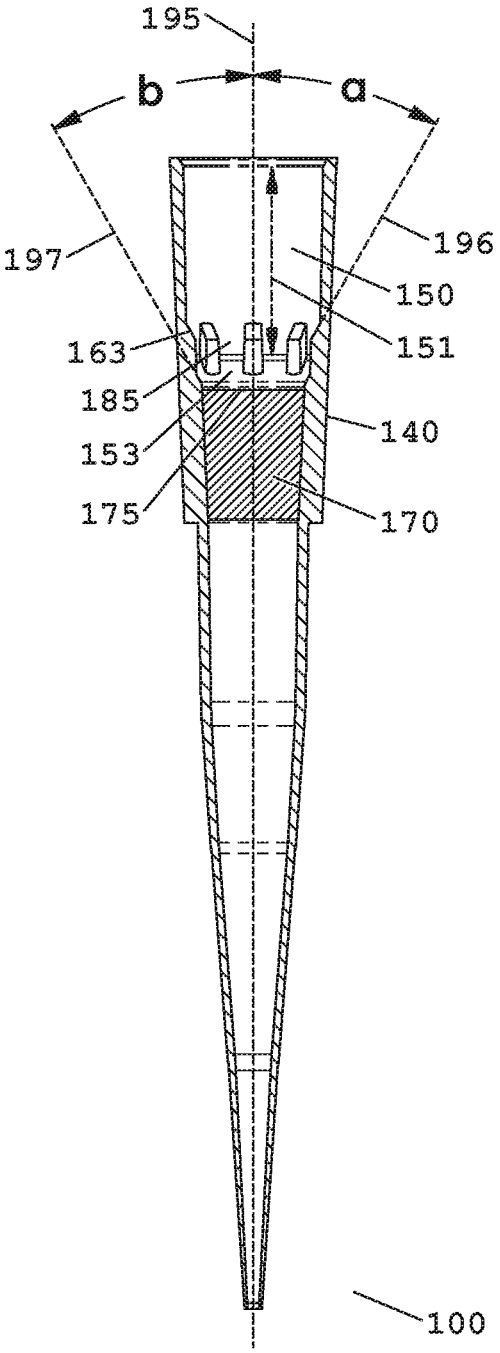
FIG. 10 is a section view thereof through cutting plane B-B shown in FIG. 2.
Figure 11:
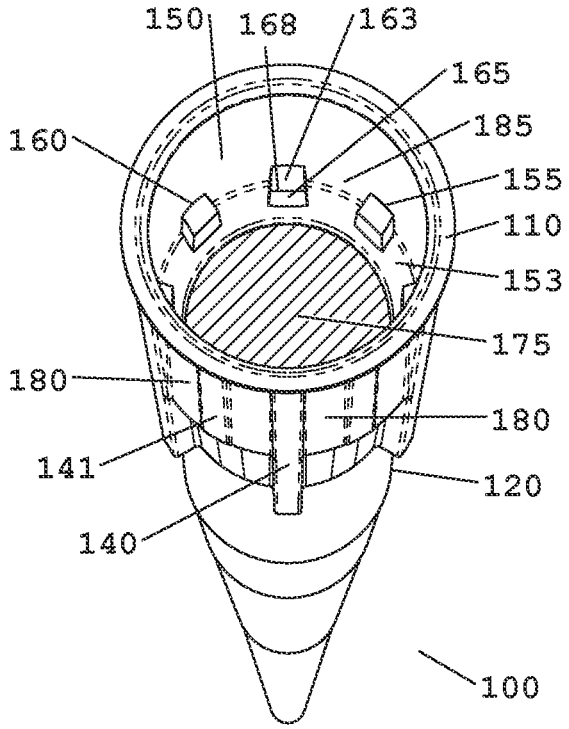
FIG. 11 is a top, front perspective view thereof.
Figure 12:
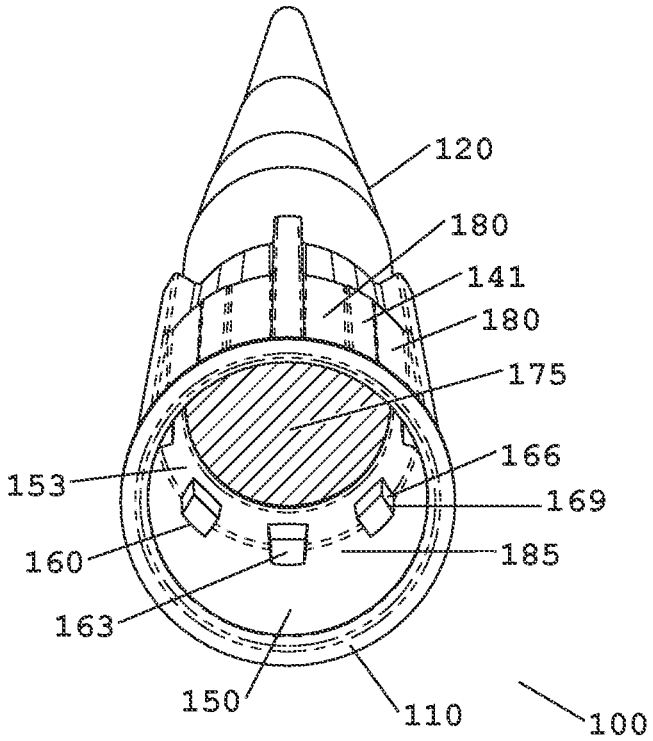
FIG. 12 is a top, rear perspective view thereof.

A non-limiting example of a pipette tip having interior ribs is pipette tip embodiment 100. A pipette tip often includes the following features illustrated for pipette tip 100: proximal terminus 105, proximal opening 107, interior surface 115, exterior surface 120, proximal region 130, distal region 135, distal terminus 125 and distal opening 127. A pipette tip sometimes includes flange 110 and flange distal terminus 113 as illustrated for pipette tip 100. A pipette tip that includes a filter sometimes includes a filter configured as illustrated as filter 170 for pipette tip 100, which includes distal surface 173 and proximal surface 175. A pipette tip sometimes includes interior ribs as illustrated for pipette tip 100, such as interior rib 155 having proximal terminus 160, proximal surface 163, axial surface 165, side surface 166 and distal terminus 167, for example. While the transition between proximal surface 163 and axial surface 165 is an edge transition (i.e., beveled transition 168), the transition between these two surfaces sometimes is a curved transition (i.e., rounded transition). Similarly, while the transition between (i) proximal surface 163 and side surface 166, and (ii) and proximal surface 163 and axial surface 165, is an edge transition (i.e., beveled transition 168), the transition between these two surfaces sometimes is a curved transition (i.e., rounded transition). FIG. 10 shows virtual longitudinal axis 195 disposed at and extending through the center of pipette tip 100, and virtual axis 196 collinear with interior rib proximal surface 163. FIG. 10 also shows angle a, which is an angle (e.g., draft angle) between axis 195 and axis 196. A pipette tip may have an angle a of about 10 degrees to about 80 degrees relative to the longitudinal axis (e.g., about 20 degrees to about 70 degrees, about 25 degrees to about 65 degrees, about 30 degrees to about 60 degrees, about 20 degrees to about 40 degrees, about 25 degrees to about 35 degrees about 35 degrees to about 55 degrees, about 40 degrees to about 50 degrees, about 50 degrees to about 70 degrees, about 55 degrees to about 65 degrees (e.g., about 20, 25, 26, 27, 28, 29, 30, 31, 32, 33, 34, 35, 40, 41, 42, 43, 44, 45, 46, 47, 48, 49, 50, 55, 56, 57, 58, 59, 60, 61, 62, 63, 64, 65, 70 degrees).

Figure 13:
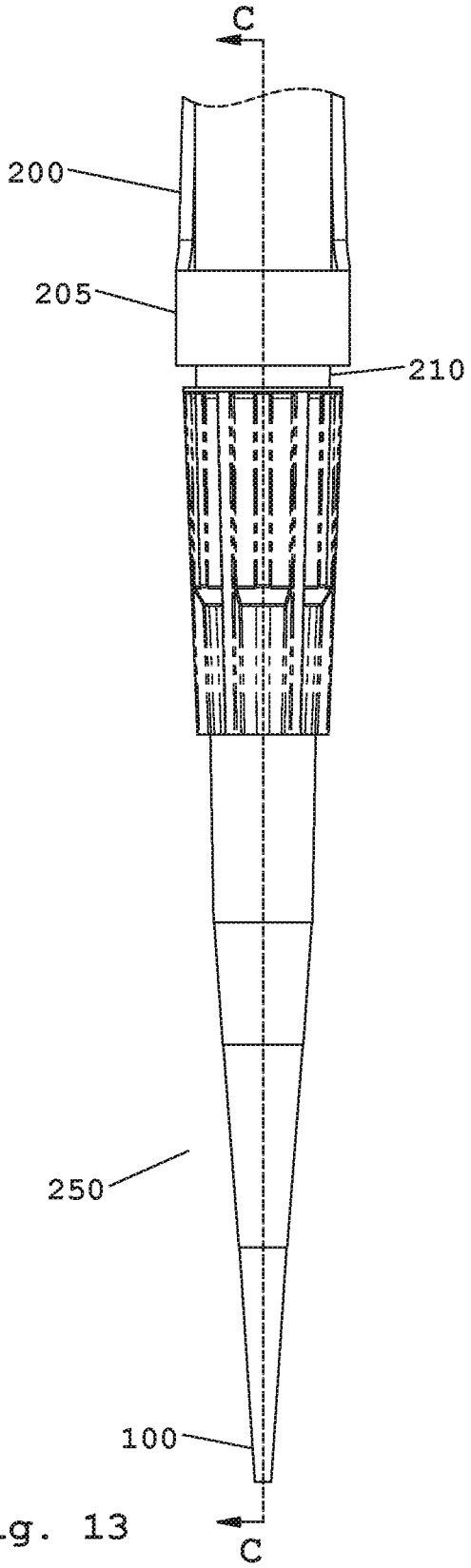
FIG. 13 is a front view of assembly 250 that includes pipette tip embodiment 100 and fluid dispenser 200.
Figure 14:
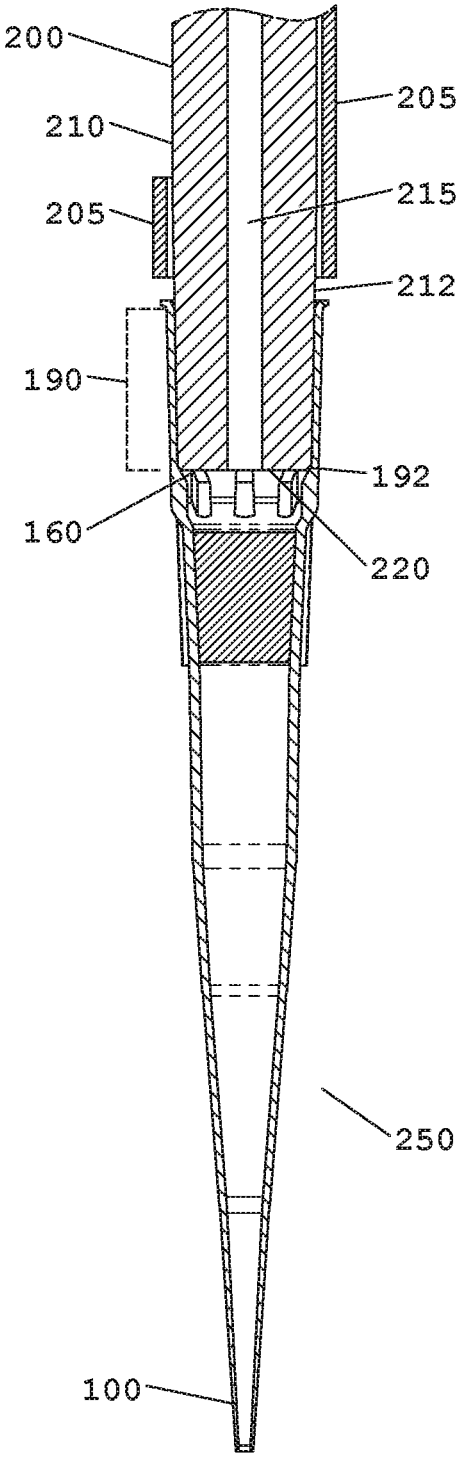
FIG. 14 is a section view thereof through cutting plane C-C shown in FIG. 13.
Figure 15:
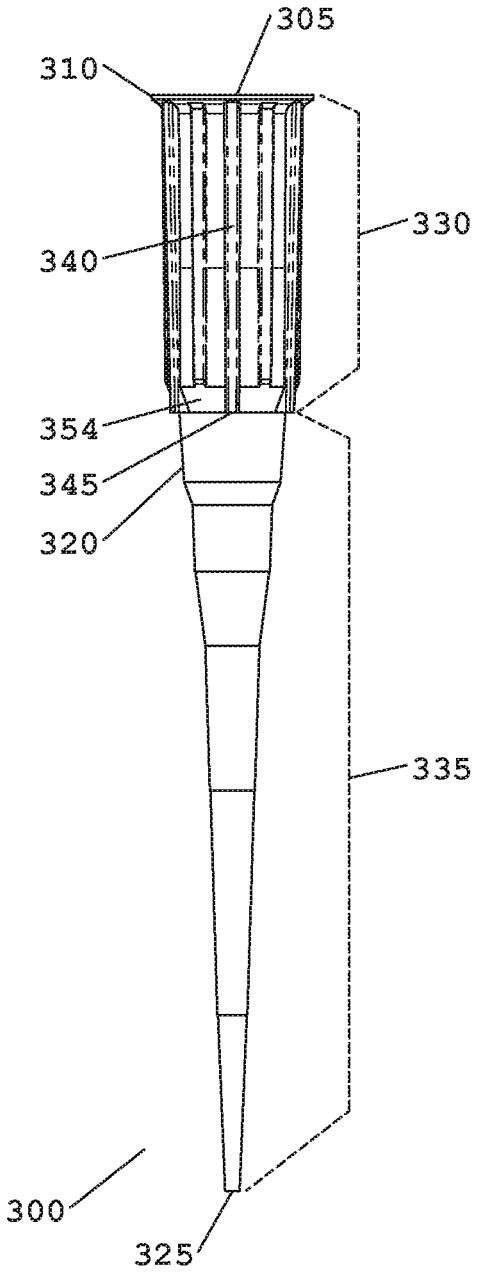
FIG. 15 is a front view of pipette tip embodiment 300 that includes exterior ribs and interior ribs.
Figure 16:
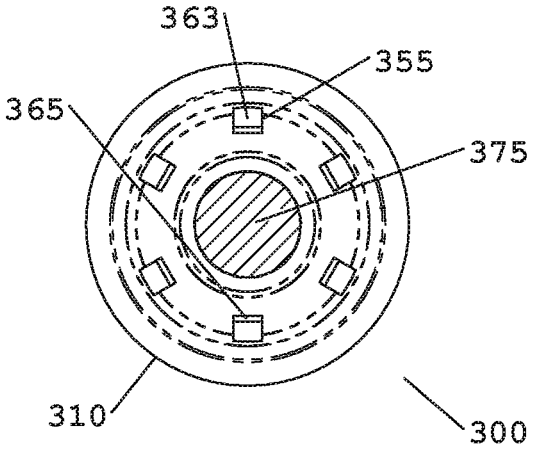
FIG. 16 is a top view thereof.
Figure 17:
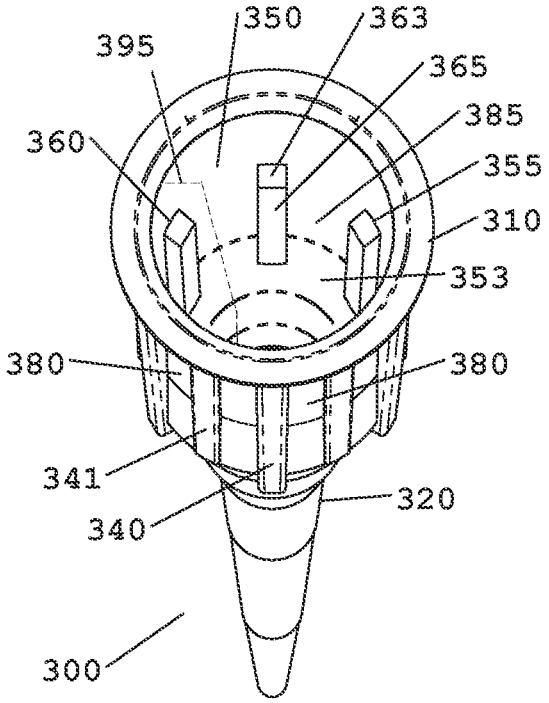
FIG. 17 is a top, front perspective view thereof.
Figure 18:
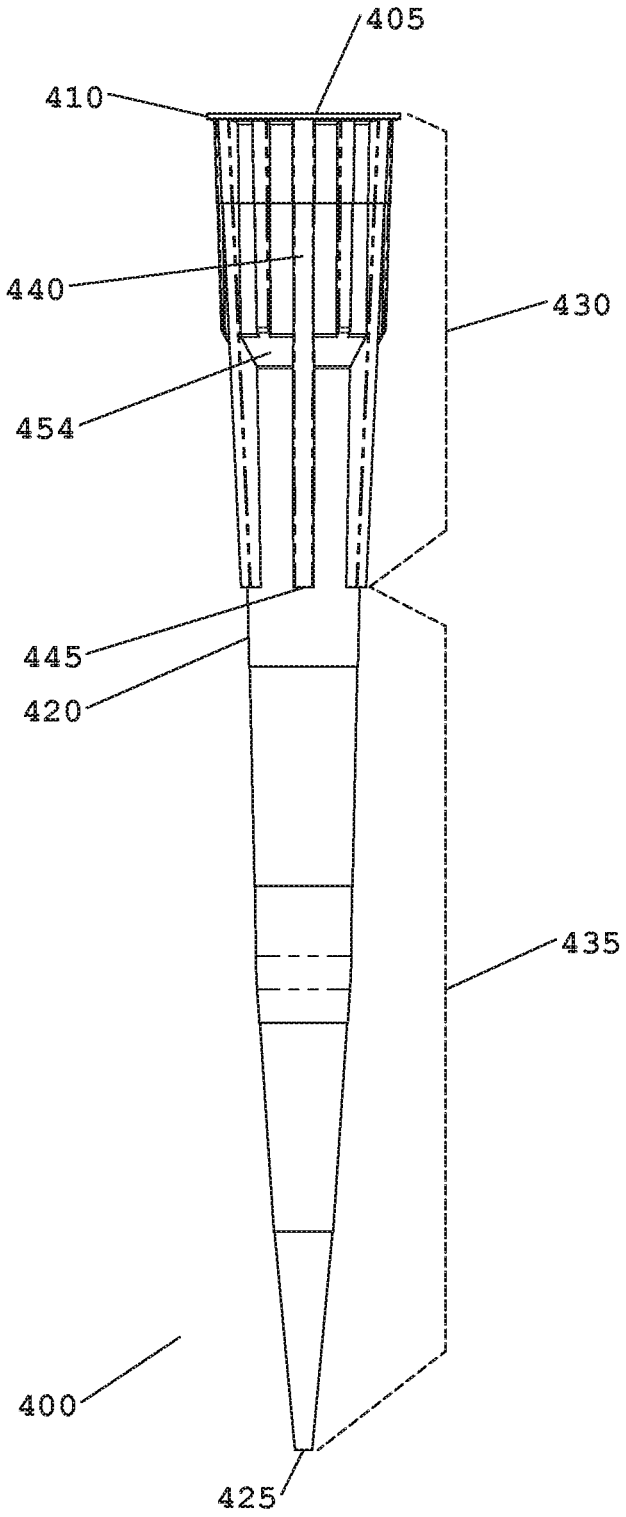
FIG. 18 is a front view of pipette tip embodiment 400 that includes exterior ribs and interior ribs.
Figure 19:
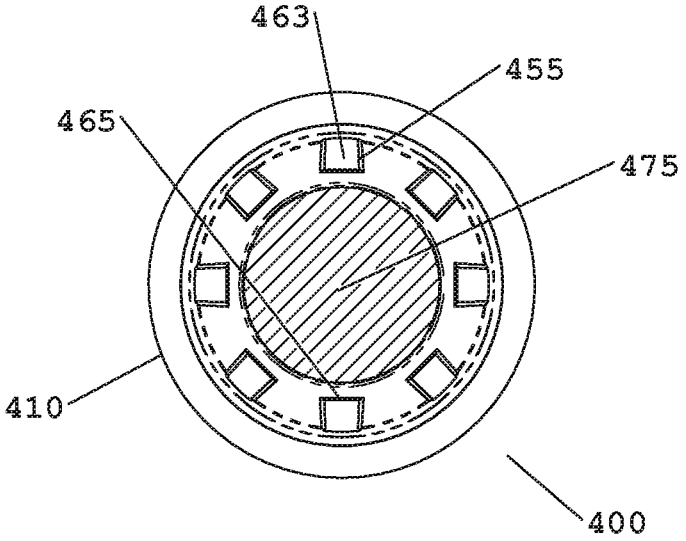
FIG. 19 is a top view thereof.
Figure 20:
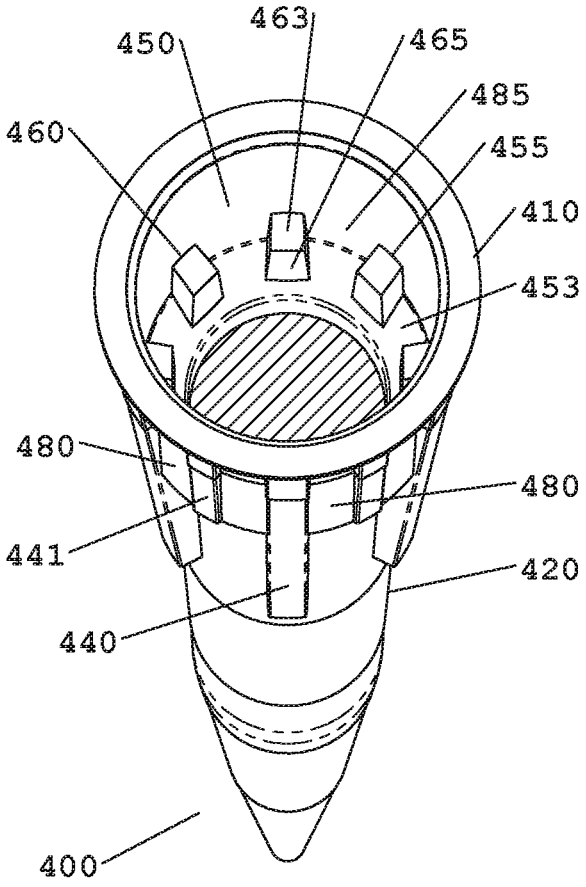
FIG. 20 is a top, front perspective view thereof.
Figure 21:
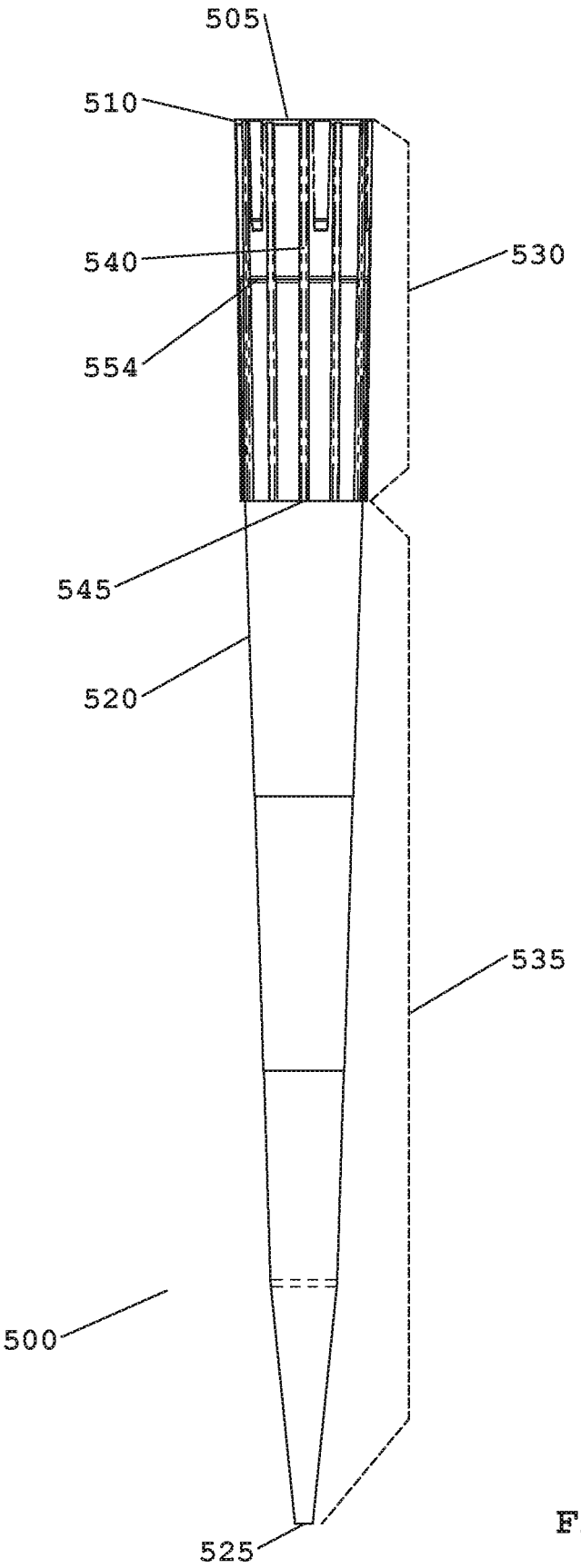
FIG. 21 is a front view of pipette tip embodiment 500 that includes exterior ribs and interior ribs.
Figure 22:
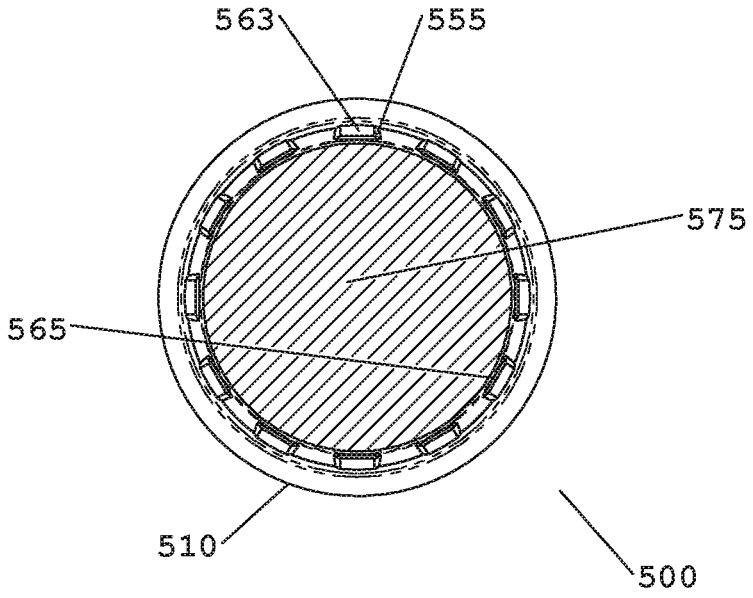
FIG. 22 is a top view thereof.
Figure 23:
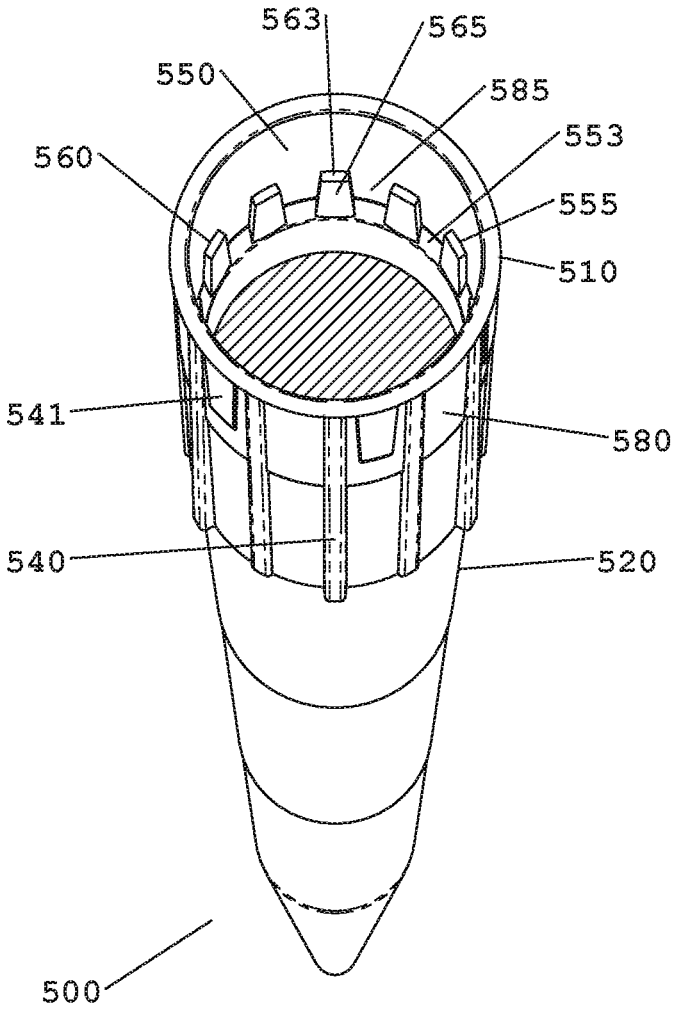
FIG. 23 is a top, front perspective view thereof.
Figure 24:
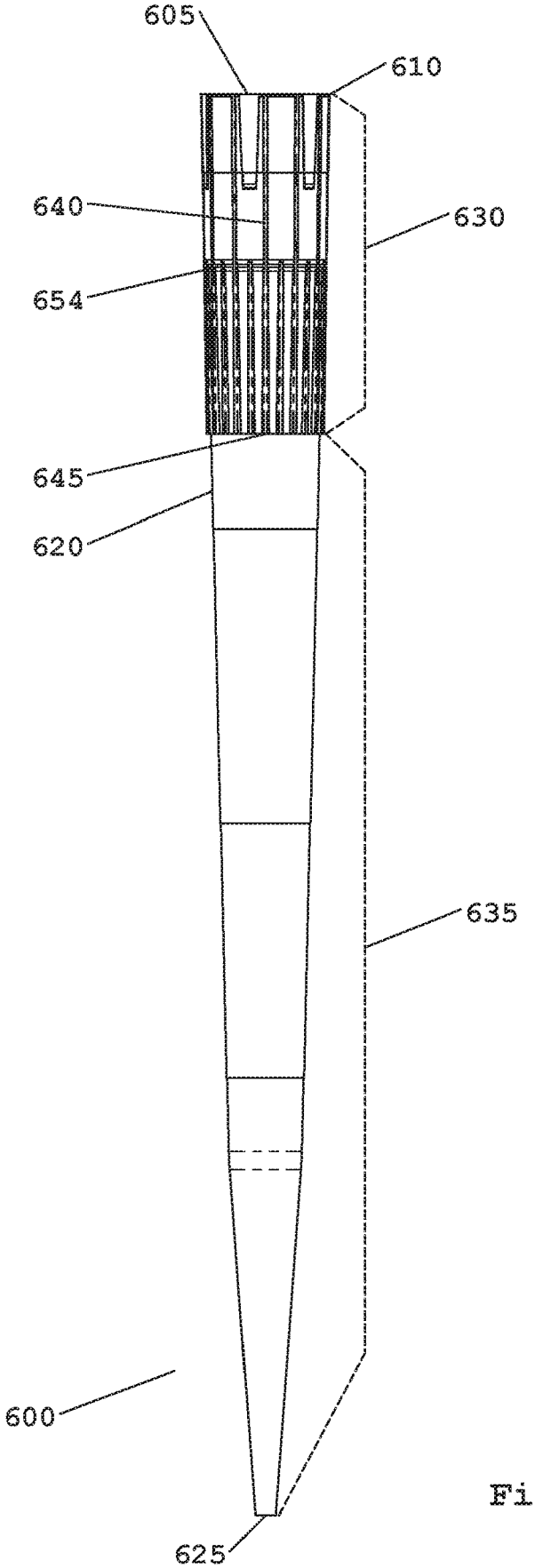
FIG. 24 is a front view of pipette tip embodiment 600 that includes exterior ribs and interior ribs.
Figure 25:
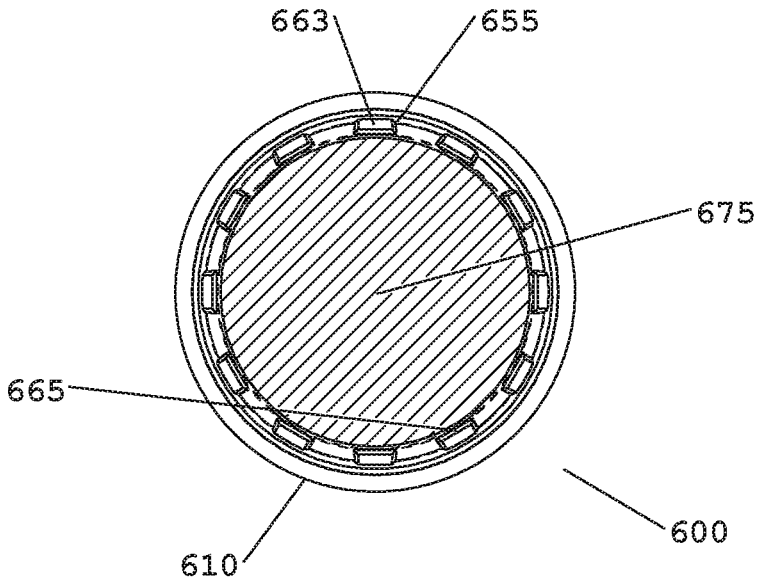
FIG. 25 is a top view thereof.
Figure 26:
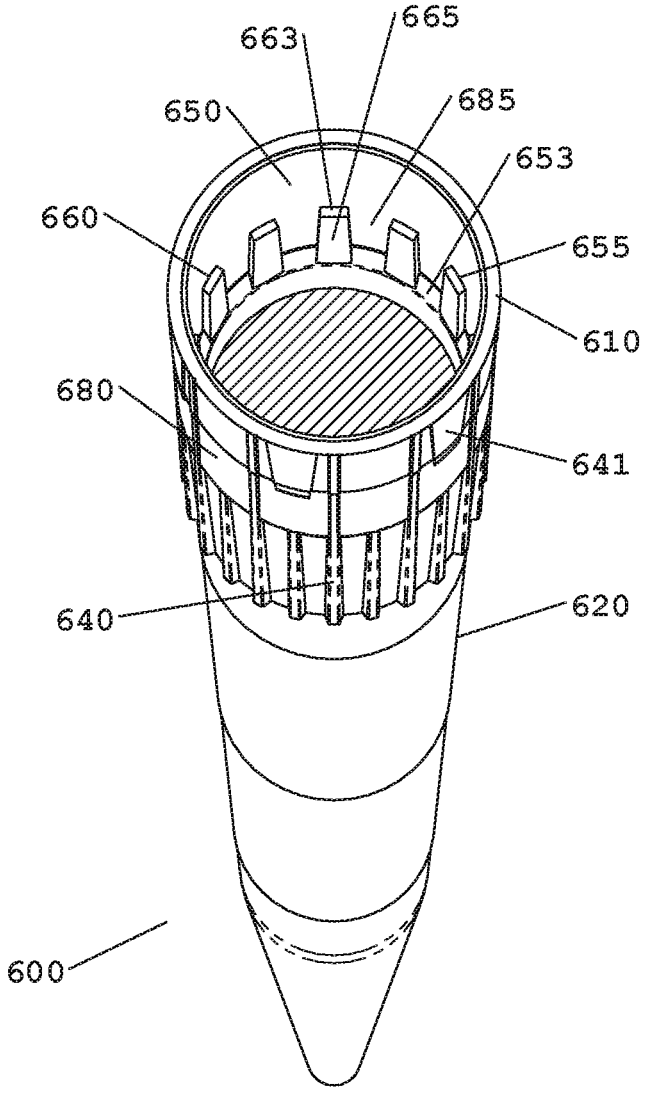
FIG. 26 is a top, front perspective view thereof.

A non-limiting example of a portion of a manual fluid dispensing device embodiment 200 is shown in FIG. 13 and FIG. 14, which is referred to herein as a nozzle member. A fluid dispensing device can include one or more of ejector 205, nozzle 210, interior channel 215 and nozzle distal terminus 220, as illustrated for fluid dispenser 200 in FIG. 13 and FIG. 14, for example. A non-limiting example of an interaction between a pipette tip and a fluid dispenser nozzle member sometimes is configured as for sealing zone 190 shown in FIG. 10, where nozzle distal terminus 220 is disposed at proximal terminus 160 of interior ribs 155 at junction 192, as illustrated for pipette tip 100.

Without being limited by theory, the depth that a fluid dispenser nozzle is inserted into a pipette tip often is positively correlated with (i) the adhesion force generated between the nozzle and the pipette tip and (ii) the force required to overcome the adhesion force to eject the pipette tip from the dispenser (i.e., ejection force). Thus, a greater depth of insertion often is correlated with a greater adhesion force and a greater ejection force. A fluid dispenser nozzle insertion depth generally is the distance between (i) the point on the nozzle adjacent to the pipette tip proximal terminus, and (ii) the nozzle distal terminus. Ejection force can be measured by any suitable method (e.g., using a digital force gauge), and ejection force can be determined for different insertion depths of a fluid dispenser nozzle in a pipette tip interior.

Insertion depth of a fluid dispenser nozzle also often is positively correlated with the degree of sealing of the nozzle with the pipette tip. The proximal surface of each of the interior ribs often is disposed below a sealing zone 190 and often is disposed below a nozzle insertion zone within the proximal region of the pipette tip. Sealing can be assessed by any suitable method. A non-limiting method for assessing sealing is measuring variance in fluid volume intake and emission from a pipette tip, where lower variance is associated with a higher degree of sealing. Degree of sealing between the fluid dispenser nozzle and a pipette tip can be determined for different insertion depths of a fluid dispenser nozzle in a pipette tip interior. A pipette tip often is an air displacement pipette tip (i.e., used in conjunction with an air displacement fluid dispenser), and sealing between the fluid dispenser nozzle and the pipette tip is sufficient for air displacement mediated fluid drawing and fluid emission by the pipette tip.

An optimized, predetermined fluid dispenser insertion depth can be determined (i) that provides for sealing of the nozzle with the pipette tip, with (ii) minimized ejection force. Such a predetermined fluid dispenser insertion depth often is different for pipette tips of different sizes (i.e., pipette tips capable of handling different maximum volumes, and pipette tips having a proximal terminus of varying diameter). In some embodiments, a predetermined fluid dispenser insertion depth can be determined for permitting sealing of the nozzle with the pipette tip with minimum ejection force. In certain embodiments, the predetermined fluid dispenser insertion depth is an insertion depth optimized for reduced ejection force required to remove the pipette tip from the fluid dispenser after the pipette tip has been sealingly engaged with the fluid dispenser. The proximal terminus of each of the interior ribs often is disposed at the predetermined fluid dispenser insertion depth, and in some embodiments is disposed a minimal distance above or below the predetermined fluid dispenser insertion depth (e.g., about 0.005 inches or less (e.g., about 0.004 inches or less, 0.003 inches or less, 0.002 inches or less, 0.001 inches or less) above or below the predetermined fluid dispenser insertion depth). An optimized fluid dispenser insertion depth that reduces insertion force for sealing, and/or reduces ejection force, can result in one or more of the following: reduce operator fatigue, reduce occurrence of injury (e.g., repetitive motion injury), can increase throughput, and can enhance fluid transfer accuracy.

The wall thickness in the proximal region in a contact region between a fluid dispenser nozzle and the pipette tip interior wall (e.g., in sealing zone 190 shown in FIG. 14) can be any suitable thickness that permits sealing engagement between the dispenser nozzle and pipette tip and a reasonable ejection force. The thickness between the exterior surface and the interior surface disposed (i) between two exterior ribs, and (ii) between the proximal terminus of the pipette tip to the proximal terminus of each of the interior ribs, sometimes is about 0.005 inches to about 0.015 inches (e.g., about 0.007 inches to about 0.0013 inches, 0.009 inches to about 0.011 inches (e.g., about 0.005, 0.006, 0.007, 0.008, 0.009, 0.010, 0.011, 0.012, 0.013, 0.014, 0.015 inches)). The thickness between the exterior surface and the interior surface disposed (i) between two exterior ribs, and (ii) between the distal terminus of the flange (flange distal perimeter) to the proximal terminus of each of the interior ribs, is about 0.005 inches to about 0.015 inches (e.g., about 0.007 inches to about 0.0013 inches, 0.009 inches to about 0.011 inches (e.g., about 0.005, 0.006, 0.007, 0.008, 0.009, 0.010, 0.011, 0.012, 0.013, 0.014, 0.015 inches)). Asa non-limiting example, a pipette tip may include exterior wall section 180 between exterior ribs and interior wall section 185 between interior ribs as illustrated for pipette tip 100.

In certain embodiments, the proximal terminus of each interior rib of a pipette tip is disposed at the same position on the interior wall from the proximal terminus of the pipette tip (e.g., the proximal terminus of each of interior ribs is disposed at the same depth from the proximal terminus of the pipette tip). Stated another way, the distance between the proximal terminus of the pipette tip and the proximal terminus of one interior rib is the same for all other interior ribs for the pipette tip. In such embodiments, the proximal termini of the interior ribs define a circumference around the interior wall of a pipette tip (i.e., an interior rib proximal terminus circumference (IRC). An IRC typically is the circumference around the interior surface of the pipette disposed at the interior rib proximal terminus. In some embodiments, the coverage of the proximal terminus of all interior ribs relative to the IRC is determined (i.e., interior rib circumferential coverage (IRCC)). An IRCC typically is determined for a pipette tip by determining an IRC, and assessing the fraction of the IRC disposed at the interior ribs of the pipette tip. In some embodiments, an IRCC is determined by determining the sum of the circumferential width (CW) disposed at the proximal terminus of the interior ribs of a pipette tip (SCW) and dividing the SCW by the IRC. An IRCC sometimes is expressed as a fraction and sometimes is expressed as a percentage. An IRCC sometimes is about 15 percent to about 60 percent for a pipette tip. An IRCC sometimes is about 15 percent to about 30 percent, about 18 percent to about 29 percent, or about 20 percent to about 26 percent (e.g., about 18, 19, 20, 21, 22, 23, 24, 25, 26, 27, 28, 29, 30 percent). An IRCC sometimes is about 25 percent to about 45 percent, about 28 percent to about 38 percent, or about 30 percent to about 36 percent (e.g., about 29, 29, 30, 31, 32, 33, 34, 35, 36, 37, 38, 39, 30 percent). An IRCC sometimes is about 30 percent to about 50 percent, about 33 percent to about 43 percent, or about 35 percent to about 41 percent (e.g., about 33, 34, 35, 36, 37, 38, 39, 40, 41, 42, 43 percent). An IRCC sometimes is about 40 percent to about 60 percent, about 47 percent to about 57 percent, about 42 percent to about 52 percent, about 49 percent to about 55 percent, or about 44 percent to about 50 percent (e.g., about 40, 41, 42, 43, 44, 45, 46, 47, 48, 49, 50, 51, 52, 53, 54, 55, 56, 57, 58, 59, 60 percent).

If an angle of the proximal surface, relative to a virtual longitudinal axis disposed at, and traversing through, the center of the pipette tip interior, for a modified interior rib design (i.e., angle a) is significantly less than angle a for a base design, the IRCC can be increased for the modified design. Increasing the IRCC can increase the probability that a fluid dispenser nozzle distal terminus is not inserted past the interior rib proximal termini for the modified design. If an angle a for a modified interior rib design is significantly greater than angle a for a base design, the IRCC optionally can be decreased for the modified design. The IRCC can be increased or decreased in any suitable manner. Sometimes (i) the number of interior ribs is increased or decreased, sometimes (ii) the proximal terminus circumferential width of one or more of the interior ribs is increased or decreased (i.e., the circumferential width of the interior ribs is increased or decreased), or sometimes (iii) a combination of (i) and (ii) is performed.

Figure 9:
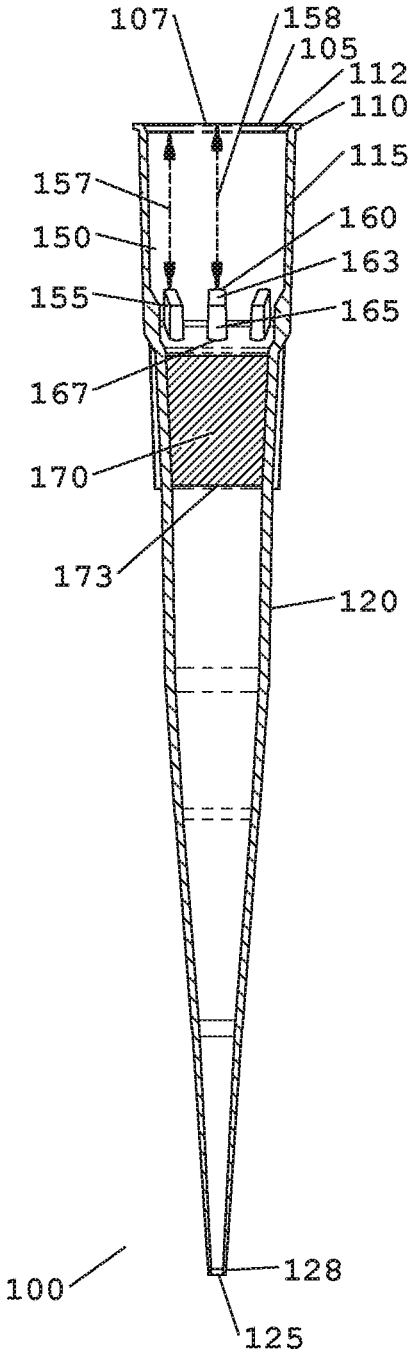
FIG. 9 is a section view thereof through cutting plane A-A shown in FIG. 3.

The interior surface of a pipette tip in a region proximal of the distal terminus of the interior ribs (i) often does not include a protrusion (e.g., is free of a protrusion; does not include an annular protrusion) and/or (ii) often is smooth or substantially smooth. A pipette tip provided herein often does not include an annular protrusion having a proximal surface, a distal surface, and an edge surface between the proximal surface and the distal surface oriented towards the pipette tip interior. A pipette tip provided herein often does not include an annular protrusion in which the edge surface is defined an axial width of less than 0.005 inches. The region proximal of the distal terminus of the interior ribs sometimes is defined by an axial distance (i.e., parallel to a virtual longitudinal axis (e.g., virtual longitudinal axis 195) that extends to the pipette tip flange distal perimeter or the pipette tip proximal terminus (e.g., axial distance 157 or 158 illustrated in FIG. 9 for pipette tip 100). For example, the interior wall surface of a pipette tip defined by axial distance 157 (i.e., vertical distance 157) between (i) interior rib proximal terminus 160 and (ii) flange distal perimeter 112, as illustrated in FIG. 9, often does not include a protrusion (e.g., does not include an annular protrusion) and/or often is smooth or substantially smooth. In another example, the interior wall surface of a pipette tip defined by distance 158 (i.e., vertical distance 158) between (i) interior rib proximal terminus 160 and (ii) pipette tip proximal terminus 105, as illustrated in FIG. 9, often does not include a protrusion (e.g., does not include an annular protrusion) and/or often is smooth or substantially smooth.

The interior surface of a pipette tip, in a region proximal of the distal terminus of the interior ribs, where the region includes a smooth or substantially smooth interior surface and/or is free of a protrusion (e.g., free of an annular protrusion), or a substantial portion of the interior surface in the region, often is configured to contact the exterior surface of a dispenser nozzle inserted in the pipette tip. In some embodiments, all or substantially all of the interior surface of the pipette tip defined by (A) the axial distance between (i) the interior rib proximal terminus and (ii) flange distal perimeter, or defined by (B) the axial distance between (i) the interior rib proximal terminus and (ii) pipette tip proximal terminus, is configured to contact the exterior surface of a dispenser nozzle inserted in the pipette tip (e.g., region 190 illustrated in FIG. 14).

In certain embodiments, a portion of the interior surface of the pipette tip defined by (A) the axial distance between (i) the interior rib proximal terminus and (ii) flange distal perimeter, or defined by (B) the axial distance between (i) the interior rib proximal terminus and (ii) pipette tip proximal terminus, is configured to contact the exterior surface of a dispenser nozzle inserted in the pipette tip. The portion sometimes is about 10% to about 90% of the axial distance (e.g., about 15%, 20%, 25%, 30%, 35%, 40%, 45%, 50%, 55%, 60%, 65%, 70%, 75%, 80%, 85% of the axial distance). A portion of the interior surface of a pipette tip configured to contact an exterior surface of a dispenser and defined by a portion of the axial distance, (i) often is an axially-disposed continuous, uninterrupted surface, (ii) often is bounded by an adjacent axially-disposed proximal surface and an adjacent axially-disposed distal surface, each of which are not configured to contact the exterior surface of a dispenser, and/or (iii) often is defined by a proximal perimeter located at or adjacent to the flange distal perimeter or the pipette tip proximal terminus. An axially-disposed surface generally is a surface parallel to or nearly parallel to a virtual longitudinal axis (e.g., virtual longitudinal axis 195). In some embodiments, a portion of the interior surface of a pipette tip is a continuous surface defined by an axial distance of about 0.005 inches or greater (e.g., 0.006 inches or greater, 0.007 inches or greater, 0.008 inches or greater, 0.009 inches or greater, 0.01 inches or greater, 0.02 inches or greater, 0.03 inches or greater, 0.04 inches or greater, 0.05 inches or greater, 0.06 inches or greater, 0.07 inches or greater, 0.08 inches or greater, 0.09 inches or greater, 0.10 inches or greater, 0.20 inches or greater, 0.30 inches or greater, 0.40 inches or greater, 0.50 inches or greater), and where the axial distance is the same as or less than (A) the axial distance between (i) the interior rib proximal terminus and (ii) flange distal perimeter, or (B) the axial distance between (i) the interior rib proximal terminus and (ii) pipette tip proximal terminus. A contact region, between the interior surface of a pipette tip and the exterior surface of a fluid dispenser nozzle, and which is a distance along the interior surface of a pipette tip that is parallel to or nearly parallel to a virtual longitudinal axis (e.g., virtual longitudinal axis 195), sometimes is referred to as an "extended contact region." An extended contact region is greater than a contact region of 0.005 inches, and can advantageously provide versatility between pipette tips and dispenser nozzles of different sizes and shapes. Stated another way, an extended contact region allows for a reduced contact region for certain pipette tip/dispenser nozzle combinations while at the same time ensuring that the pipette tip and dispenser nozzle of the combination form a seal.

In certain embodiments, the interior surface of the pipette tip includes a first interior wall section in the proximal region and a second interior wall section in the proximal region. The first interior wall section sometimes includes a continuously tapered interior wall surface having a first angle relative to the longitudinal axis. The second interior wall section in the proximal region sometimes includes a continuously tapered interior wall surface having a second angle relative to the longitudinal axis. Each of the first interior wall section and the second interior wall section sometimes tapers from the proximal end to the distal end of the wall section, and the second angle sometimes is greater than the first angle. In certain embodiments. the first interior wall section is adjacent to the second interior wall section. The first interior wall section sometimes consists of the continuously tapered interior wall surface, and the second interior wall section sometimes consists of the continuously tapered interior wall surface. In some embodiments, each interior rib includes a distal terminus, and at least a portion of the distal terminus of each interior rib is in connection with the second interior wall section.

The angle (e.g., draft angle) of the first interior wall section, relative to the longitudinal axis, sometimes is about 0.1 degrees to about 2 degrees (e.g., about 0.2 degrees to about 1.5 degrees, about 0.3 degrees to about 1.2 degrees, or about 0.5 degrees to about 1.2 degrees (e.g., about 0.5, 0.6, 0.7, 0.8, 0.9, 1.0, 1.1, 1.2 degrees)). The angle (e.g., draft angle) of the second interior wall section, relative to the longitudinal axis (e.g., angle b shown in FIG. 10), sometimes is about 5 degrees to about 40 degrees, about 5 degrees to about 15 degrees, about 15 degrees to about 30 degrees, and about 20 degrees to about 40 degrees (e.g., about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40 degrees). The distance between the proximal terminus of a pipette tip and the distal terminus of the first interior wall section of the pipette tip (e.g., distance 151 shown in FIG. 10 for pipette tip 100) sometimes is about 0.25 inches to about 0.55 inches, about 0.30 inches to about 0.50 inches, about 0.32 inches to about 0.48 inches, about 0.30 to about 0.35 inches, about 0.35 to about 0.40 inches, about 0.40 inches to about 0.45 inches, or about 0.45 inches to about 0.50 inches (e.g., about 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55 inches).

A pipette tip may include one or more of first interior wall section 150, second interior wall section 153, and an exterior wall section opposite second interior wall section 154, as illustrated for pipette tip 100, in non-limiting embodiments. The first interior wall section 150 may be defined in a pipette tip by axial length 151 as illustrated for pipette tip 100 in FIG. 10. As shown for pipette tip 100, virtual axis 197 is collinear with the second interior wall section surface 153, and the angle of the second interior wall section surface 153 sometimes is defined by angle b (e.g., draft angle) between virtual longitudinal axis 195 and virtual axis 197. Non-limiting examples of angle b are about 5 degrees to about 40 degrees, about 5 degrees to about 15 degrees, about 15 degrees to about 30 degrees, and about 20 degrees to about 40 degrees (e.g., about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40 degrees).

Interior ribs and exterior ribs may be circumferentially distributed in any suitable spacing. Sometimes, interior ribs and exterior ribs independently are regularly distributed (i.e., the same distance between adjacent ribs for all exterior ribs and/or all interior ribs) and sometimes are irregularly distributed, where the distance between two adjacent ribs differs from the distance between two other adjacent ribs. Interior ribs sometimes are disposed opposite exterior ribs of a pipette tip, and sometimes one or more interior ribs are not disposed opposite exterior ribs.

A pipette tip provided herein often does not include (i) a continuous annular step disposed around the interior surface, (ii) a continuous annular step disposed at a location at which a dispenser distal terminus would be disposed when a dispenser is inserted into the pipette tip, and/or (iii) a continuous annular step that includes a proximal surface disposed at an angle between about 81 degrees to about 99 degrees relative to a virtual longitudinal axis through the center of the pipette tip interior.

Other Pipette Tip Features

In some embodiments, a pipette tip includes a flange (e.g., an annular flange) disposed on the exterior surface at the proximal opening of the pipette tip. In certain embodiments. each exterior rib includes a proximal terminus, and the proximal terminus of each exterior rib is in connection with the flange.

In certain embodiments, the plurality of exterior ribs includes a first set of exterior ribs and a second set of exterior ribs. The exterior ribs of the first set sometimes have a maximum thickness greater than the maximum thickness of exterior ribs of the second set. Each exterior rib of the first set sometimes alternates with each rib of the second set. The proximal terminus of the exterior ribs of the first set, the proximal terminus of the exterior ribs of the second set, or the proximal terminus of the exterior ribs of the first set and the second set, sometimes is co-extensive with, or terminates at, the flange. In some embodiments, the proximal terminus of the exterior ribs of the first set, the proximal terminus of the exterior ribs of the second set, or the proximal terminus of the exterior ribs of the first set and the second set, is co-extensive with, or terminates at, the junction between the flange and the proximal region. In certain embodiments, the distal terminus of the exterior ribs of the first set, the distal terminus of the exterior ribs of the second set, or the distal terminus of the exterior ribs of the first set and the second set, is co-extensive with, or terminates at, the junction between the proximal region and the distal region. In some embodiments, the exterior ribs of the first set, the exterior ribs of the second set, or the exterior ribs of the first set and the second set, extend from the junction of the flange and proximal region to the junction of the proximal region and distal region.

Figure 5:
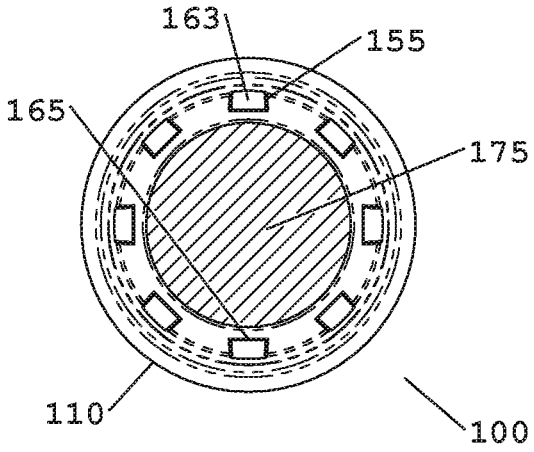
FIG. 5 is a top view thereof.
Figure 6:
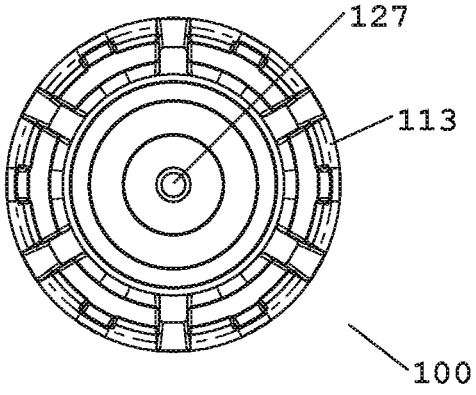
FIG. 6 is a bottom view thereof.
Figure 7:
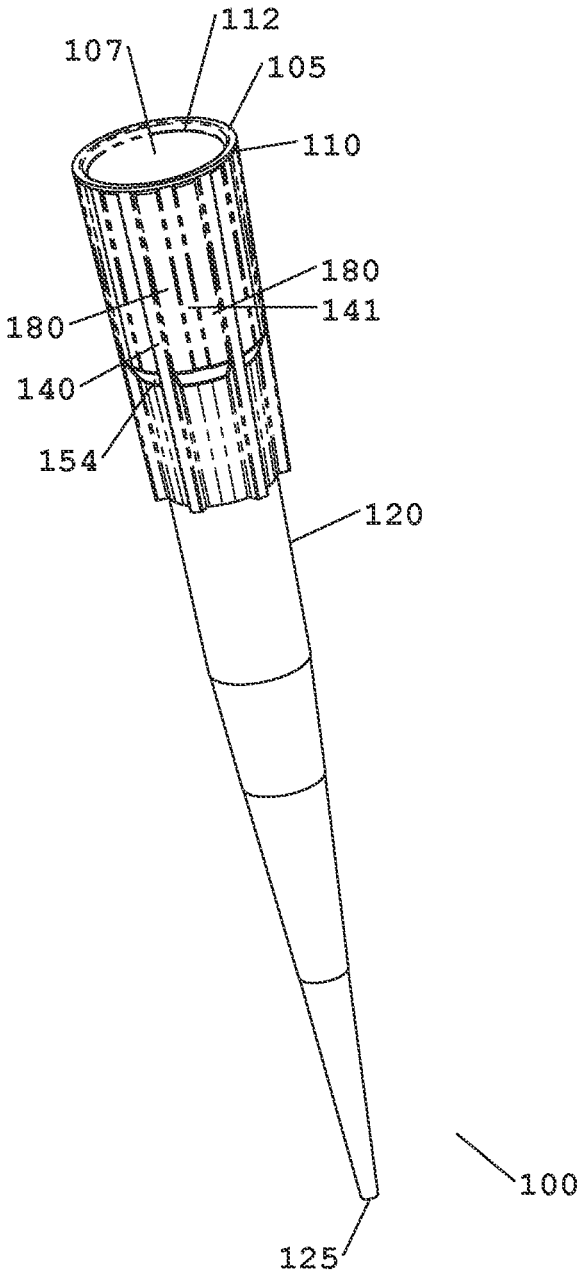
FIG. 7 is a top perspective view thereof.
Figure 8:
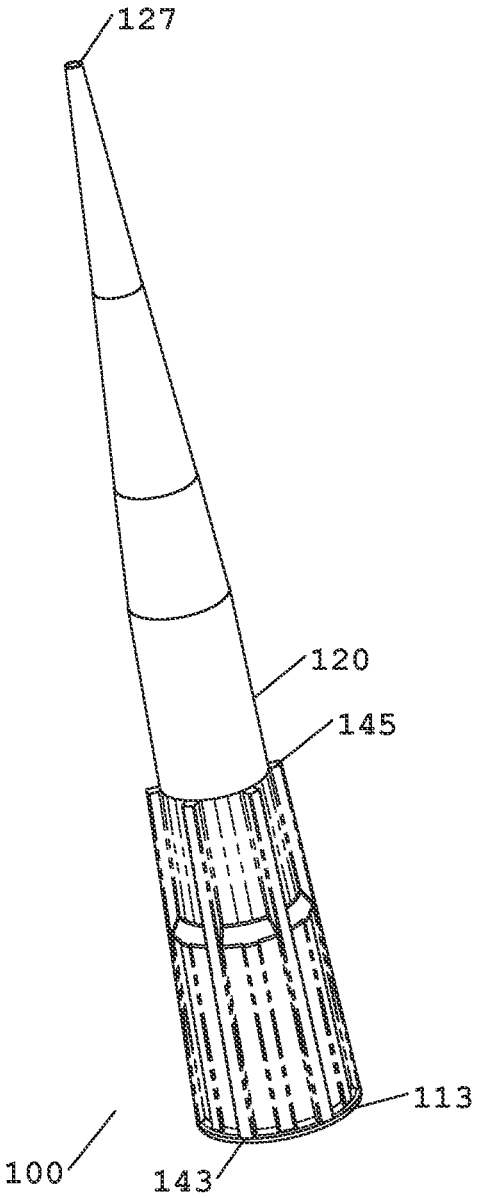
FIG. 8 is a bottom perspective view thereof.

In some embodiments, an interior rib is aligned with an exterior rib of a pipette tip, where (i) all or a portion of the proximal terminus of an interior rib is co-localized with a cross section of an exterior rib, and (ii) the cross section of the exterior rib is at a cutting plane perpendicular to the longitudinal major exterior rib dimension at the interior rib proximal terminus (i.e., cutting plane perpendicular to axis 195 at interior rib proximal terminus 160 shown in FIG. 9 and FIG. 10). For example, when viewing a pipette tip from a top or bottom perspective (e.g., FIG. 5 or FIG. 6), an interior rib proximal terminus located at about a 12 o'clock position may be aligned with a cross section of an exterior rib at the same position (i.e., cross section at a cutting plane perpendicular to the longitudinal major exterior rib dimension), and other interior ribs located at other positions around the pipette tip may be aligned with exterior rib counterparts. One interior rib may be aligned with an exterior rib of a pipette tip, and sometimes two or more or all interior ribs are aligned with exterior rib counterparts of a pipette tip. In some embodiments, no interior ribs are aligned with an exterior rib of a pipette tip.

In certain non-limiting examples, a pipette tip can include certain exterior rib structures as illustrated for pipette tip 100. A pipette tip may, for example, include a plurality of exterior ribs 140 and a plurality of alternately-spaced exterior ribs 141, where each rib includes exterior rib proximal terminus 143 and exterior rib distal terminus 145, as illustrated for pipette tip 100. The distal terminus 145 for the exterior ribs may form collar 147 as shown for pipette tip 100, for example.

A pipette tip sometimes includes a distal terminus having a reduced thickness, which can increase volume delivery consistency by reducing the amount fluid that adheres to the distal terminus relative to a pipette tip not having a distal terminus with reduced thickness. In some embodiments, the wall thickness at the distal region terminus is about 0.0040 inches to about 0.0055 inches (e.g., about 0.0043 inches to about 0.0050 inches, or about 0.0044 inches to about 0.0049 inches (e.g., about 0.0040, 0.0041, 0.0042, 0.0043, 0.0044, 0.0045, 0.0046, 0.0047, 0.0048, 0.0049, 0.0050, 0.0051, 0.0052, 0.0053, 0.0054 0.0055 inches). The interior surface of the distal region sometimes is smooth and sometimes is substantially smooth. The exterior surface of the distal region sometimes includes a step (e.g., 1, 2, 3, 4, 5, 6, 7, 8, 9, 10 steps). In certain embodiments, the distal region wall thickness tapers from (a) a point at or between (i) about the junction of the proximal region and distal region to (ii) about one-quarter of the axial distance from the terminus of the distal region to the junction, to (b) the distal region terminus. Additional details regarding pipette tips that include such features are addressed in International PCT Application No. PCT/US2011/022129 filed on Jan. 21, 2011, which published as publication no. WO2011/091308 on Jul. 28, 2011. A pipette tip may include a region of reduced thickness 128 as illustrated for pipette tip 100, in certain non-limiting embodiments.

Features of pipette tips described herein are applicable to a wide range of pipette sizes. In certain embodiments, (i) elements shown for pipette tip 100 are applicable to pipette tips that can deliver a maximum volume of about 200 microliters to about 300 microliters (e.g., about 250 microliters), (ii) elements shown for pipette tip 300 are applicable to pipette tips that can deliver a maximum volume of about 15 microliters to about 25 microliters (e.g., about 20 microliters), (iii) elements shown for pipette tip 400 are applicable to pipette tips that can deliver a maximum volume of about 250 microliters to about 350 microliters (e.g., about 300 microliters), (iv) elements shown for pipette tip 500 are applicable to pipette tips that can deliver a maximum volume of about 800 microliters to about 1,200 microliters (e.g., about 1,000 microliters), and (v) elements shown for pipette tip 600 are applicable to pipette tips that can deliver a maximum volume of about 1,100 microliters to about 1,500 microliters (e.g., about 1,300 microliters).

In certain embodiments, a pipette tip that can deliver a maximum volume of about 15 microliters to about 25 microliters (e.g., about 15, 16, 17, 18, 19, 20, 21, 22, 23, 24, 25 microliters) includes one, two, three or four of the following features: (i) an angle between the interior rib proximal surface and the longitudinal axis (i.e., angle a) of about 40 degrees to about 50 degrees (e.g., about 40, 41, 42, 43, 44, 45, 46, 47, 48, 49, 50 degrees); (ii) a distance between the pipette tip proximal terminus to the interior rib proximal terminus of about 0.10 inches to about 0.35 inches (e.g., about 0.12, 0.14, 0.15, 0.16, 0.17, 0.18, 0.19, 0.20, 0.21, 0.22, 0.23, 0.24, 0.25, 0.26, 0.28, 0.30, 0.32, 0.34 inches); (iii) an IRCC of about 18 percent to about 28 percent or about 20 percent to about 26 percent (e.g., about 18, 19, 20, 21, 22, 23, 24, 25, 26, 27, 28 percent); and (iv) 4 to 8 interior ribs (i.e., 4, 5, 6, 7 or 8 interior ribs).

In some embodiments, a pipette tip that can deliver a maximum volume of about 200 microliters to about 300 microliters (e.g., about 220, 240, 250, 260, 280 microliters) includes one, two, three or four of the following features: (i) an angle between the interior rib proximal surface and the longitudinal axis (i.e., angle a) of about 25 degrees to about 35 degrees (e.g., about 25, 26, 27, 28, 29, 30, 31, 32, 33, 34, 35 degrees); (ii) a distance between the pipette tip proximal terminus to the interior rib proximal terminus of about 0.20 inches to about 0.40 inches (e.g., about 0.20, 0.22, 0.24, 0.25, 0.26, 0.27, 0.28, 0.29, 0.30, 0.31, 0.32, 0.33, 0.34, 0.35, 0.36, 0.38, 0.40 inches); (iii) an IRCC of about 28 percent to about 38 percent or about 30 percent to about 36 percent (e.g., about 28, 29, 30, 31, 32, 33, 34, 35, 36, 37, 38 percent); and (iv) 6 to 10 interior ribs (i.e., 6, 7, 8, 9 or 10 interior ribs).

In certain embodiments, a pipette tip that can deliver a maximum volume of about 250 microliters to about 350 microliters (e.g., about 260, 280, 300, 320, 340 microliters), includes one, two, three or four of the following features: (i) an angle between the interior rib proximal surface and the longitudinal axis (i.e., angle a) of about 40 degrees to about 50 degrees (e.g., about 40, 41, 42, 43, 44, 45, 46, 47, 48, 49, 50 degrees); (ii) a distance between the pipette tip proximal terminus to the interior rib proximal terminus of about 0.20 inches to about 0.40 inches (e.g., about 0.20, 0.22, 0.24, 0.25, 0.26, 0.27, 0.28, 0.29, 0.30, 0.31, 0.32, 0.33, 0.34, 0.35, 0.36, 0.38, 0.40 inches); (iii) an IRCC of about 33 percent to about 43 percent or about 35 percent to about 41 percent (e.g., about 33, 34, 35, 36, 37, 38, 39, 40, 41, 42, 43 percent); and (iv) 6 to 10 interior ribs (i.e., 6, 7, 8, 9 or 10 interior ribs).

In some embodiments, a pipette tip that can deliver a maximum volume of about 800 microliters to about 1,200 microliters (e.g., about 800, 900, 1,000, 1,100 or 1,200 microliters), includes one, two, three or four of the following features: (i) an angle between the interior rib proximal surface and the longitudinal axis (i.e., angle a) of about 55 degrees to about 65 degrees (e.g., about 55, 56, 57, 58, 59, 60, 61, 62, 63, 64, 65 degrees); (ii) a distance between the pipette tip proximal terminus to the interior rib proximal terminus of about 0.20 inches to about 0.40 inches (e.g., about 0.20, 0.22, 0.24, 0.25, 0.26, 0.27, 0.28, 0.29, 0.30, 0.31, 0.32, 0.33, 0.34, 0.35, 0.36, 0.38, 0.40 inches); (iii) an IRCC of about 47 percent to about 57 percent or about 49 percent to about 55 percent (e.g., about 47, 48, 49, 50, 51, 52, 53, 54, 55, 56, 57 percent; and (iv) 10 to 14 interior ribs (i.e., 10, 11, 12, 13 or 14 interior ribs).

In certain embodiments, a pipette tip that can deliver a maximum volume of about 1,100 microliters to about 1,500 microliters (e.g., about 1,100, 1,200, 1,300, 1,400, 1,500 microliters) includes one, two, three or four of the following features: (i) an angle between the interior rib proximal surface and the longitudinal axis (i.e., angle a) of about 55 degrees to about 65 degrees (e.g., about 55, 56, 57, 58, 59, 60, 61, 62, 63, 64, 65 degrees); (ii) a distance between the pipette tip proximal terminus to the interior rib proximal terminus of about 0.20 inches to about 0.40 inches (e.g., about 0.20, 0.22, 0.24, 0.25, 0.26, 0.27, 0.28, 0.29, 0.30, 0.31, 0.32, 0.33, 0.34, 0.35, 0.36, 0.38, 0.40 inches); (iii) an IRCC of about 42 percent to about 52 percent or about 44 to about 50 percent (e.g., about 42, 43, 44, 45, 46, 47, 48, 49, 50 percent); and (iv) 10 to 14 interior ribs (i.e., 10, 11, 12, 13 or 14 interior ribs).

Pipette Tip Assemblies

An array of pipette tips, where each of the pipette tips in the array is a pipette tip described herein, can be assembled in certain embodiments. An array of pipette tips sometimes is associated with a pipette tip receptacle plate (e.g., referred to as a "plate" herein). A plate sometimes is associated with a tray base, and sometimes is associated with a tray lid.

A plurality of plates, where each plate contains an array of pipette tips, can be manufactured as an assembly and provided (e.g., packaged, distributed) for use. An array of pipette tips sometimes is associated with a sheet described herein. A plurality of sheets, where each sheet retains an array of pipette tips, can be manufactured as an assembly and provided (e.g., packaged, distributed) for use. An array of pipette tips disposed in a plate and retained by a sheet also can be provided as a sheet/plate combination, and a plurality of sheet/plate combinations manufactured as an assembly and provided (e.g., packaged, distributed) for use. An assembly that includes a plurality of plates and/or sheets each containing an array of pipette tips can be utilized for any suitable application, and sometimes such an assembly is utilized as part of a pipette tip reload system. A reload system can economically make use of several plates, each containing an array of pipette tips, in conjunction with (i) only one base or a limited number of bases, and (ii) one lid or a limited number of lids. An array of pipette tips sometimes includes 12, 16, 24, 32, 48, 64, 96, 128, 256, 384 or 1536 pipette tips. A plate and/or a sheet described herein sometimes includes an array of bores configured for association with a pipette tip, and sometimes a plate or a sheet includes 12, 16, 24, 32, 48, 64, 96, 128, 256, 384 or 1536 bores.

In certain embodiments, the distal surface of each of two of the plates or sheets oppose one another in an assembly. In such assembly embodiments, the distal portion of each of the pipette tips disposed in the first plate or first sheet often is adjacent to the distal portion of a pipette tip disposed in the second plate or second sheet.

In some embodiments, the distal surface of a first plate or first sheet is disposed proximally to a proximal surface of a second plate or second sheet for at least two of the plates or sheets in an assembly, and the distal surface of the first plate or first sheet is spaced from the proximal surface of the second plate or second sheet. In such assembly embodiments, at least a portion of the distal portion of the each of the pipette tips disposed in the first plate or first sheet often is nested within a pipette tip disposed in the second plate or second sheet.

Thus, provided in certain embodiments, is an assembly including an array of pipette tips, where each of the pipette tips in the array is a pipette tip described herein. In some embodiments, provided is an assembly that includes a pipette tip tray and an array of pipette tips. In such embodiments, a tray typically includes a base, typically includes a pipette tip receptacle plate in association with the base, and often includes a lid in association with the plate and/or the base. A plate generally includes a proximal surface, a distal surface and an array of bores each traversing the proximal surface to the distal surface, and each pipette tip in the array of pipette tips often is disposed in a bore of the plate.

Provided in certain embodiments is an assembly that includes an array of pipette tips described herein retained by a sheet. A sheet often includes a proximal surface, a distal surface and an array of holes. Each of the holes of the sheet generally includes an interior hole edge and each of the holes of the sheet generally has an effective diameter.

Each pipette tip in the array of pipette tips sometimes is disposed in a hole of a sheet. The hole edge of each of the holes of the sheet sometimes contacts an exterior surface of a pipette tip disposed in the hole of the sheet, and the effective diameter of the holes of the sheet sometimes is less than the outer diameter of the exterior surface of the pipette tip in contact with the hole edge. The hole edge sometimes contacts the exterior surface of the pipette tip by an interference fit, and sometimes the hole edge retains the pipette tip by a force greater than the force of gravity. The distal surface of a sheet sometimes contacts the proximal surface of the plate, and sometimes the holes in the sheets are concentric with the bores of the plate. The distal rib terminus of each of the exterior ribs of each pipette tip contacts the proximal surface of the sheet in certain embodiments.

In certain embodiments, each of the pipette tips in the array of pipette tips includes a proximal terminus and a proximal terminus interior diameter, and the distal surface of a sheet is adhered to the proximal terminus of the pipette tips in the array of pipette tips. Each of the pipette tips in such assemblies sometimes is adhered to the distal surface of the sheet by an adhesive. Each of the holes of the sheet sometimes is concentric with the proximal terminus interior diameter of a pipette tip. In such embodiments, the sheet sometimes retains the pipette tips by an adhesion force greater than the force of gravity, and sometimes the holes of the sheet are concentric with bores in the array of bores in the plate.

Methods of Manufacture

A pipette tip described herein may be manufactured by any suitable process. Non-limiting examples of manufacturing processes include thermoforming, vacuum forming, pressure forming, plug-assist forming, reverse-draw thermoforming, matched die forming, extrusion, casting and injection molding.

A pipette tip often is of a unitary construction and is molded from one material (i.e., a unitary pipette tip). A unitary pipette tip sometimes is molded from one material (e.g., a moldable polymer comprising polypropylene), and the entire pipette tip, including the proximal region, distal region, sidewalls and internal ribs are of the same material. A unitary pipette tip manufactured from a first material sometimes includes an internal filter constructed from a second material, where the first material (e.g., polypropylene) is different than the second material (e.g., polyethylene). A pipette tip sometimes is of a multi-part construction, and two or more parts sometimes are molded separately (e.g., double-shot pipette tip). A multi-part pipette tip sometimes includes a distal region manufactured from a first moldable material and a proximal region manufactured from a second moldable material, where the second moldable material sometimes has a greater elasticity than the first moldable material (see, e.g., FIG. 5 of U.S. Pat. No. 7,335,337). A unitary pipette tip or a multi-part pipette tip sometimes includes no elastomer. A multi-part pipette tip, for example, sometimes includes a distal region manufactured from a first moldable material and a proximal region manufactured from a second moldable material, where the second moldable material contains an elastomer, and the first moldable material contains no elastomer, a different elastomer than the elastomer in the second moldable material or a lower content of the same elastomer as in the second moldable material. A unitary pipette tip or a multi-part pipette tip sometimes includes no elastomer.

Some or all elements of a pipette tip sometimes include, or are manufactured from, a suitable polymer or polymer mixture. Non-limiting examples of polymers include low density polyethylene (LDPE), high-density polyethylene (HDPE), polypropylene (PP), high impact polystyrene (HIPS), polyvinyl chloride (PVC), amorphous polyethylene terephthalate (APET), polycarbonate (PC) and polyethylene (PE). One or more elements of a pipette tip can include, or can be manufactured from, a recyclable material and/or degradable material (e.g., a bio-degradable material), non-limiting examples of which are disclosed in International Application no. PCT/US2009/063762 filed on Nov. 9, 2009 and published as WO 2010/054337 on May 14, 2010. One or more elements of a pipette tip, in some embodiments, include an anti-microbial agent, non-limiting examples of which are disclosed in International Application no. PCT/US2009/047541 filed on Jun. 16, 2009 and published as WO 2010/008737 on Jan. 10, 2010 (e.g., antimicrobial metal (e.g., silver)).

A pipette tip described herein sometimes is manufactured by a method that includes: dispensing a molten polymer into a cavity of a mold configured to mold a pipette tip described herein, permitting the polymer in the cavity to cool, and releasing the formed pipette tip from the mold after cooling. The mold sometimes includes a metal, and sometimes the mold is manufactured from a metal. The metal sometimes includes one or more of aluminum, zinc, steel or a steel alloy. Non-limiting examples of a polymer is provided herein. In certain embodiments, the molding process is an injection molding process.

Also provided herein in certain embodiments is a mold for manufacturing a pipette tip described herein by a molding process (e.g., injection molding process), which includes a body that forms exterior surfaces of the pipette tip and a member that forms interior surfaces of the pipette tip. A mold sometimes includes one or more core components that form interior surfaces of the pipette tip (e.g., core pin component).

A pipette tip sometimes is manufactured by an injection molding process. Injection molding is a manufacturing process for producing objects from thermoplastic (e.g., nylon, polypropylene, polyethylene, polystyrene and the like, for example) or thermosetting plastic (e.g., epoxy and phenolics, for example) materials. A plastic material (e.g., a polymer material) of choice often is fed into a heated barrel, mixed, and forced into a mold cavity where it cools and hardens to the configuration of the mold cavity. The melted material sometimes is forced or injected into the mold cavity, through openings (e.g., a sprue), under pressure. A pressure injection method often ensures the complete filling of the mold with the melted plastic. After the mold cools, mold portions are separated, and the molded object is ejected.

A plastic with higher flow and lower viscosity sometimes is selected for use in injection molding processes. Non-limiting examples of plastics with higher flow and lower viscosity include any suitable moldable material having one or more of the following properties: a melt flow rate (230 degrees Celsius at 2.16 kg) of about 30 to about 75 grams per 10 minutes using an ASTM D 1238 test method; a tensile strength at yield of about 3900 to about 5000 pounds per square inch using an ASTM D 638 test method; a tensile elongation at yield of about 7 to about 14% using an ASTM D 638 test method; a flexural modulus at 1% sectant of about 110,000 to about 240,000 pounds per square inch using an ASTM D 790 test method; a notched Izod impact strength (23 degrees Celsius) of about 0.4 to about 4.0 foot pounds per inch using an ASTM D 256 test method; and/or a heat deflection temperature (at 0.455 MPa) of about 160 degrees to about 250 degrees Fahrenheit using an ASTM D 648 test method. Non-limiting examples of materials that can be used include polypropylene, polystyrene, polyethylene, polycarbonate, the like, and mixtures thereof. In some embodiments, additional additives can be included in the plastic or mold to impart additional properties to the final product (e.g., anti-microbial, degradable, anti-static properties). A pipette tip can be injection molded as a unitary construct.

A mold often is configured to retain molten plastic in a geometry that yields the desired product upon cooling of the plastic. Injection molds sometimes are made of two or more parts. Molds typically are designed so that the molded part reliably remains on the ejector side of the mold after the mold opens, after cooling. The molded part may fall freely away from the mold when ejected from ejector side of the mold. In some embodiments, an ejector sleeve pushes the molded part from the ejector side of the mold.

A pipette tip described herein can include any suitable filter. A filter can be of any shape (e.g., plug, disk; U.S. Pat. Nos. 5,156,811 and 7,335,337) and can be manufactured from any material that impedes or blocks migration of aerosol through the pipette tip to the proximal section terminus, including without limitation, polyester, polyethylene (e.g., botryoid ultrahigh molecular weight polyethylene), cork, plastic, silica, gels, and the like, and combinations thereof. In some embodiments a filter may be porous, non-porous, hydrophobic, hydrophilic or a combination thereof. A filter in some embodiments may include vertically oriented pores, and the pore size may be regular or irregular. Pores of a filter may include a material (e.g., granular material) that can expand and plug pores when contacted with aerosol (e.g., U.S. Pat. No. 5,156,811). In certain embodiments, a filter may include nominal, average or mean pore sizes of about 30, 25, 20, 15, 10, 9, 8, 7, 6, 5, 4, 3, 2, 1, 0.5, or 0.05 micrometers, for example. A filter sometimes includes particles (e.g., sintered particles), and the particle sometimes are about 5 micrometers to about 1,000 micrometers in diameter. A filter disposed within a pipette tip sometimes is not a disk filter. A filter disposed within a pipette tip sometimes is a plug filter, which often includes a distal surface, a proximal surface, and a sidewall between the distal surface and the proximal surface. A plug filter sometimes is a cylinder or frustum, and the sidewall of a plug filter sometimes is about 0.01 inches to about 0.5 inches in length between the distal surface and the proximal surface, and sometimes the sidewall is about 0.02 inches or greater, 0.03 inches or greater, 0.04 inches or greater, 0.05 inches or greater, 0.06 inches or greater, 0.07 inches or greater, 0.08 inches or greater, 0.09 inches or greater, 0.10 inches or greater, 0.15 inches or greater, 0.20 inches or greater, 0.25 inches or greater, 0.30 inches or greater, 0.35 inches or greater, 0.40 inches or greater, 0.45 inches or greater in length between the proximal surface and the distal surface.

A pipette tip described herein can be loaded with a filter by a method that includes: disposing a filter at the proximal terminus of a pipette tip described herein, and applying a force to the proximal surface of the filter. The force often is applied in a direction parallel to the virtual longitudinal axis described herein, the distal surface of the filter often contacts and passes over the proximal surface of the interior ribs, and the force often is applied until the proximal surface of the filter is disposed at a position distal to the distal terminus of each of the interior ribs. The force sometimes is applied by a press device known in the art. A pipette tip provided herein often is manufactured by a process that does not include insert molding the filter in the pipette tip.

A portion of a pipette tip also may include an insert or material that can interact with a molecule or analyte of interest, such as a biomolecule. The insert or material may be located in any suitable location for interaction with a molecule of interest, and sometimes is located in the distal portion of a pipette tip (e.g., a material or a terminus of an insert may be located at or near the distal opening of the pipette tip). An insert may include one or more components that contain, without limitation, multicapillaries (e.g., US 2007/0017870), fibers (e.g., randomly oriented or stacked, parallel orientation), and beads (e.g., silica gel, glass (e.g. controlled-pore glass (CPG)), nylon, Sephadex®, Sepharose®, cellulose, a metal surface (e.g. steel, gold, silver, aluminum, silicon and copper), a magnetic material, a plastic material (e.g., polyethylene, polypropylene, polyamide, polyester, polyvinylidenedifluoride (PVDF)), Wang resin, Merrifield resin or Dynabeads®). Beads may be sintered (e.g., sintered glass beads) or may be free (e.g., between one or two barriers (e.g., filter, frit)). Each insert, or an insert component, may be coated or derivitized (e.g., covalently or non-covalently modified) with a molecule that can interact with (e.g., bind to) a molecule of interest (e.g., C18, nickel, affinity substrate). An insert or material may be placed into a pipette tip by any suitable method, including without limitation, use of a press device that applies a force to the insert and presses it through the distal opening or proximal opening of a pipette tip into the distal region.

Methods of Use

Pipette tips described herein can be used in a method that includes: inserting a fluid dispenser member into a pipette tip described herein, where the fluid dispenser member often seals with an interior surface of the pipette tip, and receiving fluid into the pipette tip. The fluid sometimes is dispensed from the pipette tip, and the pipette tip sometimes is ejected from the fluid dispenser member. Fluid often is received into the pipette tip, and often is dispensed from the pipette tip, by air displacement.

Any suitable dispensing device can be utilized, including without limitation, a manual dispenser, an automated dispenser, a single nozzle dispenser and a multi-nozzle dispenser. A nozzle of a fluid handling device often is inserted a distance into the interior of a pipette tip until the nozzle is sealingly engaged with the pipette tip. A fluid dispenser sometimes includes a nozzle member, nozzle member distal terminus, and a nozzle exterior wall, sometimes a portion of the nozzle member is inserted within the proximal portion of the pipette tip, sometimes a portion of the nozzle exterior wall is in contact with a portion of the interior wall of the pipette tip, the portion of the nozzle exterior wall sometimes is in contact with at least a portion of the first interior wall section of the pipette tip, and sometimes the nozzle member distal terminus is in contact with the proximal terminus of the interior ribs of the pipette tip. A non-limiting example of a portion of a manual fluid dispensing device embodiment 200 is shown in FIG. 13 and FIG. 14 in combination with a pipette tip sealingly engaged with the nozzle.

A pipette tip sometimes is ejected from a fluid dispenser upon actuation of an ejection member of the dispenser. An ejection member sometimes displaces upon actuation and exerts a force on the proximal terminus of the pipette tip in an amount sufficient to separate the pipette tip from the nozzle of the dispenser.

Examples of Embodiments

Provided hereafter are certain non-limiting examples of embodiments of the technology.

A1. A pipette tip, comprising a proximal opening, a distal opening, a proximal region, a distal region, an exterior surface, an interior surface, and a plurality of interior ribs, wherein:

each interior rib of the plurality of interior ribs is axially disposed on the interior surface of the pipette tip in the proximal region;

the interior ribs of the plurality of interior ribs are circumferentially distributed around the interior surface of the pipette tip;

each interior rib of the plurality of interior ribs comprises an axial surface facing the pipette tip interior and an adjoining proximal surface; and the proximal surface of each of the interior ribs is disposed at an angle between 10 degrees and 80 degrees relative to a longitudinal axis through the center of the pipette tip interior.

A1.1. The pipette tip of embodiment A1, wherein each interior rib of the plurality of interior ribs comprises an axial surface facing the pipette tip interior and an adjoining beveled proximal surface.

A2. The pipette tip of embodiment A1 or A1.1, comprising a length between the proximal opening and the distal opening, wherein:

the proximal region comprises a proximal region length;

the distal region comprises a distal region length;

the proximal region adjoins the distal region; and the proximal region length is about 45% or less of the length between the proximal opening and the distal opening.

A2.1. The pipette tip of embodiment A1, A1.1 or A2, wherein the distal terminus of the proximal region protrudes as a shoulder from the adjoining proximal terminus of the distal region.

A3. The pipette tip of embodiment A1, A1.1 or A2, comprising a plurality of exterior ribs, wherein:

each exterior rib of the plurality of exterior ribs is axially disposed on the exterior surface of the pipette tip;

the exterior ribs of the plurality of exterior ribs are circumferentially distributed around the exterior surface of the pipette tip;

each exterior rib of the plurality of exterior ribs comprises a distal terminus.

A4. The pipette tip of embodiment A3, wherein:

the proximal region of the pipette tip is from the proximal opening of the pipette tip to the distal terminus of the exterior ribs; and the distal region of the pipette tip is from distal opening to the distal terminus of the exterior ribs.

A5. The pipette tip of embodiment A1 or A1.1, comprising a plurality of exterior ribs, wherein:

each exterior rib of the plurality of exterior ribs is axially disposed on the exterior surface of the pipette tip;

the exterior ribs of the plurality of exterior ribs are circumferentially distributed around the exterior surface of the pipette tip;

each exterior rib of the plurality of exterior ribs comprises a distal terminus;

the proximal region of the pipette tip is from the proximal opening of the pipette tip to the distal terminus of each of the exterior ribs; and the distal region of the pipette tip is from distal opening to the distal terminus of the exterior ribs.

A5.1. The pipette tip of embodiment A5, wherein the distal terminus of each of the exterior ribs protrude from the proximal terminus of the distal region and form a shoulder.

A6. The pipette tip of any one of embodiments A1-A5, wherein:

each of the interior ribs comprises a distal terminus;

the pipette tip comprises a filter comprising a proximal surface and a distal surface; and the proximal surface of the filter is disposed at or is distally spaced from the distal terminus of the each of the interior ribs.

A7. The pipette tip of any one of embodiments A1-A6, wherein:

each of the interior ribs comprises a proximal terminus, and a region of the interior surface of the pipette tip between the pipette tip proximal opening and the proximal terminus of the interior ribs comprises no annular protrusion.

A8. The pipette tip of embodiment A7, wherein the region of the interior surface of the pipette tip between the pipette tip proximal opening and the proximal terminus of the interior ribs comprises no protrusion.

A9. The pipette tip of embodiment A7 or A8, wherein the region of the interior surface of the pipette tip between the pipette tip proximal opening and the proximal terminus of the interior ribs is smooth.

A10. The pipette tip of embodiment A7 or A8, wherein the region of the interior surface of the pipette tip between the pipette tip proximal opening and the proximal terminus of the interior ribs is substantially smooth.

A11. The pipette tip of any one of embodiments A7-A10, wherein the region of the interior surface of the pipette tip between the pipette tip proximal opening and the proximal terminus of the interior ribs, or portion of the region of the interior surface along the axial distance between the pipette tip proximal opening and the proximal terminus of the interior ribs, is configured to contact the exterior surface of a dispenser nozzle that can be inserted in the pipette tip.

A12. The pipette tip of embodiment A11, wherein the portion is about 10% to about 85% of the axial distance between the pipette tip proximal opening and the proximal terminus of the interior ribs.

A13. The pipette tip of embodiment A11 or A12, wherein the region, or the portion of the region, of the interior surface, is an axially-disposed continuous, uninterrupted surface.

A14. The pipette tip of any one of embodiments A11-A13, wherein:

the region, or the portion of the region, of the interior surface, is bounded by an adjacent axially-disposed proximal surface and an adjacent axially-disposed distal surface; and the adjacent axially-disposed proximal surface and the adjacent axially-disposed distal surface are not configured to contact the exterior surface of a dispenser.

A15. The pipette tip of any one of embodiments A11-A14, wherein the region, or the portion of the region, of the interior surface, is defined by a proximal perimeter located at or adjacent to the pipette tip proximal terminus.

A16. The pipette tip of any one of embodiments A11-A15, wherein:

the portion of the region of the interior surface is a continuous surface defined by an axial distance of about 0.005 inches or greater; and the axial distance is the same as or less than the axial distance between (i) the interior rib proximal terminus and (ii) the pipette tip proximal terminus.

A17. The pipette tip of any one of embodiments A1-A6, comprising a flange and a flange distal perimeter.

A18. The pipette tip of embodiment A17, wherein the region of the interior surface of the pipette tip between the flange distal perimeter and the proximal terminus of the interior ribs, or portion of the region of the interior surface along the axial distance between the flange distal perimeter and the proximal terminus of the interior ribs, is configured to contact the exterior surface of a dispenser nozzle that can be inserted in the pipette tip.

A19. The pipette tip of embodiment A18, wherein the portion is about 10% to about 85% of the axial distance between the flange distal perimeter and the proximal terminus of the interior ribs.

A20. The pipette tip of embodiment A18 or A19, wherein the region, or the portion of the region, of the interior surface, is an axially-disposed continuous, uninterrupted surface.

A21. The pipette tip of any one of embodiments A18-A20, wherein:

the region, or the portion of the region, of the interior surface, is bounded by an adjacent axially-disposed proximal surface and an adjacent axially-disposed distal surface; and the adjacent axially-disposed proximal surface and the adjacent axially-disposed distal surface are not configured to contact the exterior surface of a dispenser.

A22. The pipette tip of any one of embodiments A18-A21, wherein the region, or the portion of the region, of the interior surface, is defined by a proximal perimeter located at or adjacent to the flange distal perimeter.

A23. The pipette tip of any one of embodiments A18-A22, wherein:

the portion of the region of the interior surface is a continuous surface defined by an axial distance of about 0.005 inches or greater; and the axial distance is the same as or less than the axial distance between (i) the interior rib proximal terminus and (ii) the flange distal perimeter.

A24. The pipette tip of any one of embodiments A1-A23, wherein the proximal surface of each of the interior ribs is disposed below a nozzle sealing zone within the proximal region of the pipette tip.

A25. The pipette tip of any one of embodiments A1-A24, wherein the proximal terminus of each of the interior ribs is disposed at or below a predetermined fluid dispenser insertion depth in the proximal region of the pipette tip.

A26. The pipette tip of embodiment A25, wherein the predetermined fluid dispenser insertion depth is an insertion depth optimized for a reduced ejection force required to remove the pipette tip from the fluid dispenser after the pipette tip has been sealingly engaged with the fluid dispenser.

A27. The pipette tip of embodiment A26, wherein the predetermined fluid dispenser insertion depth is an insertion depth optimized for a minimum ejection force required to remove the pipette tip from the fluid dispenser after the pipette tip has been sealingly engaged with the fluid dispenser.

A28. The pipette tip of any one of embodiments A1-A27, wherein:

the interior surface of the pipette tip comprises a first interior wall section in the proximal region that includes a continuously tapered interior wall surface having a first angle relative to the longitudinal axis, the interior surface of the pipette tip comprises a second interior wall section in the proximal region that includes a continuously tapered interior wall surface having a second angle relative to the longitudinal axis, each of the first interior wall section and the second interior wall section tapers from the proximal end to the distal end of the wall section, and the second angle is greater than the first angle.

A29. The pipette tip of embodiment A28, wherein the first interior wall section is adjacent to the second interior wall section.

A30. The pipette tip of embodiment A28 or A29, wherein:

the first interior wall section consists of the continuously tapered interior wall surface, and the second interior wall section consists of the continuously tapered interior wall surface.

A31. The pipette tip of any one of embodiments A28-A30, wherein:

each interior rib comprises a distal terminus, and at least a portion of the distal terminus of each interior rib is in connection with the second interior wall section.

A32. The pipette tip of any one of embodiments A28-A31, wherein the angle of the first interior wall section, relative to the longitudinal axis, is about 0.2 degrees to about 2 degrees.

A33. The pipette tip of any one of embodiments A28-A32, wherein the angle of the second interior wall section, relative to the longitudinal axis, is about 5 degrees to about 40 degrees.

A34. The pipette tip of any one of embodiments A1-A33, wherein the proximal terminus of each of the interior ribs is disposed at one depth from the proximal terminus of the pipette tip.

A35. The pipette tip of any one of embodiments A1-A34, wherein the thickness between the exterior surface and the interior surface disposed (i) between two exterior ribs, and (ii) between the proximal terminus of the pipette tip to the proximal terminus of each of the interior ribs, is about 0.005 inches to about 0.015 inches.

A36. The pipette tip of any one of embodiments A1-A35, comprising a flange disposed on the exterior surface at the proximal opening of the pipette tip.

A37. The pipette tip of embodiment A36, wherein:

each exterior rib comprises a proximal terminus, and the proximal terminus of each exterior rib is in connection with the flange.

A38. The pipette tip of embodiment A36 or A37, wherein:

each interior rib comprises a distal terminus, and at least a portion of the distal terminus of each interior rib is in connection with the second interior wall section.

A39. The pipette tip of any one of embodiments A36-A38, wherein the thickness between the exterior surface and the interior surface disposed (i) between two exterior ribs, and (ii) between the distal terminus of the flange to the proximal terminus of each of the interior ribs, is about 0.005 inches to about 0.015 inches.

A40. The pipette tip of any one of embodiments A1-A39, wherein the proximal surface of each of the interior ribs is disposed at an angle between 40 degrees and 50 degrees relative to the longitudinal axis.

A41. The pipette tip of embodiment A40, wherein the proximal surface of each of the interior ribs is disposed at an angle between 25 degrees and 35 degrees relative to the longitudinal axis.

A42. The pipette tip of any one of embodiments A1-A41, wherein the pipette tip comprises a polymer.

A43. The pipette tip of any one of embodiments A1-A42, wherein the pipette tip is manufactured from a polymer.

A44. The pipette tip of embodiment A42 or A43, wherein the polymer is chosen from low density polyethylene (LDPE), high-density polyethylene (HDPE), polypropylene (PP), high-impact polystyrene (HIPS), polyvinyl chloride (PVC), polyethylene terephthalate (PET), amorphous polyethylene terephthalate (APET), polycarbonate (PC), polyethylene (PE), or combination thereof.

A45. The pipette tip of any one of embodiments A1-A44, wherein:

the plurality of exterior ribs comprises a first set of exterior ribs and a second set of exterior ribs; and exterior ribs of the first set have a maximum thickness greater than the maximum thickness of exterior ribs of the second set.

A46. The pipette tip of embodiment A45, wherein the proximal terminus of the exterior ribs of the first set, the proximal terminus of the exterior ribs of the second set, or the proximal terminus of the exterior ribs of the first set and the second set, is co-extensive with, or terminates at, the flange.

A47. The pipette tip of embodiment A45 or A46, wherein the proximal terminus of the exterior ribs of the first set, the proximal terminus of the exterior ribs of the second set, or the proximal terminus of the exterior ribs of the first set and the second set, is co-extensive with, or terminates at, the junction between the flange and the proximal region.

A48. The pipette tip of any one of embodiments A45-A47, wherein the distal terminus of the exterior ribs of the first set, the distal terminus of the exterior ribs of the second set, or the distal terminus of the exterior ribs of the first set and the second set, is co-extensive with, or terminates at, the junction between the proximal region and the distal region.

A49. The pipette tip of any one of embodiments A45-A47, wherein the exterior ribs of the first set, the exterior ribs of the second set, or the exterior ribs of the first set and the second set, extend from the junction of the flange and proximal region to the junction of the proximal and distal regions.

A50. The pipette tip of any one of embodiments A1-A49, wherein:

the distal region wall thickness tapers from (a) a point at or between (i) about the junction of the proximal region and distal region to (ii) about one-quarter of the axial distance from the terminus of the distal region to the junction, to (b) the distal region terminus, and the wall thickness at the distal region terminus is about 0.0040 inches to about 0.0055 inches.

A51. The pipette tip of embodiment A50, wherein the wall thickness at the distal region terminus is about 0.0043 inches to about 0.0050 inches.

A52. The pipette tip of embodiment A51, wherein the wall thickness at the distal region terminus is about 0.0044 inches to about 0.0049 inches.

A53. The pipette tip of any one of embodiments A1-A52, wherein the interior surface of the distal region is smooth or substantially smooth.

A54. The pipette tip of any one of embodiments A1-A53, wherein the exterior surface of the distal region comprises a step.

A55. The pipette tip of any one of embodiments A1-A54, comprising a frustum-shaped cavity within the interior of the proximal region.

A56. The pipette tip of embodiment A55, wherein the frustum-shaped cavity is substantially smooth with the exception of the interior ribs.

A57. The pipette tip of embodiment A55 or A56, wherein the frustum-shaped cavity is substantially smooth with the exception of an annular groove.

A58. The pipette tip of any one of embodiments A45-A57, wherein each exterior rib of the first set alternates with each rib of the second set.

A59. The pipette tip of any one of embodiments A1-A58, which is an air displacement pipette tip.

A59.1. The pipette tip of any one of embodiments A6-A59, wherein the filter is a plug filter.

A60. The pipette tip of any one of embodiments A1-A59.1, wherein the pipette tip is a unitary pipette tip.

A61. The pipette tip of any one of embodiments A1-A60, comprising a filter, wherein:

the filter comprises a proximal surface and each of the internal ribs comprises a distal terminus, the proximal surface of the filter is distally disposed relative to the distal terminus of each of the internal ribs, and there is no annular projection disposed on the interior surface of the pipette tip proximal to the proximal surface of the filter.

B1. An assembly comprising a pipette tip of any one of embodiments A1-A61 and a fluid dispenser, wherein:

the fluid dispenser comprises a nozzle member, nozzle member distal terminus, and a nozzle exterior wall;

a portion of the nozzle member is inserted within the proximal portion of the pipette tip;

a portion of the nozzle exterior wall is in contact with a portion of the interior wall of the pipette tip; and the nozzle member distal terminus is in contact with the proximal terminus of the interior ribs of the pipette tip.

B2. The assembly of embodiment B1, wherein the portion of the nozzle exterior wall is in contact with at least a portion of the first interior wall section of the pipette tip.

B3. An assembly comprising an array of pipette tips, wherein each of the pipette tips in the array is a pipette tip of any one of embodiments A1-A61.

B4. An assembly comprising a pipette tip tray and an array of pipette tips, wherein:

the tray comprises a base and a pipette tip receptacle plate in association with the base;

the plate comprises a proximal surface, a distal surface and an array of bores each traversing the proximal surface to the distal surface;

each pipette tip in the array of pipette tips is a pipette tip of any one of embodiments A1-A61; and each pipette tip in the array is disposed in a bore of the plate.

B5. The assembly of embodiment B4, wherein the tray comprises a lid.

B6. The assembly of any one of embodiments B3-B5, comprising a sheet, wherein:

the sheet comprises a proximal surface, a distal surface and an array of holes;

each of the holes of the sheet comprises an interior hole edge and each of the holes of the sheet has an effective diameter;

each pipette tip in the array of pipette tips is disposed in a hole of the sheet;

the hole edge of each of the holes of the sheet contacts an exterior surface of a pipette tip disposed in the hole of the sheet;

the effective diameter of the holes of the sheet is less than the outer diameter of the exterior surface of the pipette tip in contact with the hole edge.

B7. The assembly of embodiment B6, wherein the hole edge contacts the exterior surface of the pipette tip by an interference fit.

B8. The assembly of embodiment B6 or B7, wherein the hole edge retains the pipette tip by a force greater than the force of gravity.

B9. The assembly of any one of embodiments B6-B8, wherein:

the distal surface of the sheet contacts the proximal surface of the plate; and the holes in the sheets are concentric with the bores of the plate.

B10. The assembly of any one of embodiments B6-B9, wherein the distal rib terminus of each of the exterior ribs contacts the proximal surface of the sheet.

B11. The assembly of any one of embodiments B3-B5, comprising a sheet, wherein:

the sheet comprises a proximal surface, a distal surface and an array of holes;

each of the pipette tips in the array of pipette tips comprises a proximal terminus and a proximal terminus interior diameter;

the distal surface of the sheet is adhered to the proximal terminus of the pipette tips;

each of the holes of the sheet is concentric with the proximal terminus interior diameter of each of the pipette tips.

B12. The assembly of embodiment B11, wherein the sheet retains the pipette tips by an adhesion force greater than the force of gravity.

B13. The assembly of embodiment B11 or B12, wherein holes of the sheet are concentric with bores in the array of bores in the plate.

B14. The assembly of any one of embodiments B1-B13, wherein the region of the interior surface of the pipette tip between the pipette tip proximal opening and the proximal terminus of the interior ribs, or portion of the region of the interior surface along the axial distance between the pipette tip proximal opening and the proximal terminus of the interior ribs, contacts the exterior surface of a dispenser nozzle.

B15. The assembly of embodiment B14, wherein the portion is about 10% to about 90% of the axial distance between the pipette tip proximal opening and the proximal terminus of the interior ribs.

B16. The assembly of embodiment B14 or B15, wherein the region, or the portion of the region, of the interior surface, is an axially-disposed continuous, uninterrupted surface.

B17. The assembly of any one of embodiments B14-B16, wherein:

the region, or the portion of the region, of the interior surface, is bounded by an adjacent axially-disposed proximal surface and an adjacent axially-disposed distal surface; and the adjacent axially-disposed proximal surface and the adjacent axially-disposed distal surface do not contact the exterior surface of the dispenser.

B18. The assembly of any one of embodiments B14-B17, wherein the region, or the portion of the region, of the interior surface, is defined by a proximal perimeter located at or adjacent to the pipette tip proximal opening.

B19. The assembly of any one of embodiments B14-B18, wherein:

the portion of the region of the interior surface is a continuous surface defined by an axial distance of about 0.005 inches or greater; and the axial distance is the same as or less than the axial distance between (i) the interior rib proximal terminus and (ii) the pipette tip proximal opening.

B20. The assembly of embodiment B1-B13, wherein the region of the interior surface of the pipette tip between the flange distal perimeter and the proximal terminus of the interior ribs, or portion of the region of the interior surface along the axial distance between the flange distal perimeter and the proximal terminus of the interior ribs, contacts the exterior surface of the dispenser nozzle.

B21. The assembly of embodiment B20, wherein the portion is about 10% to about 90% of the axial distance between the flange distal perimeter and the proximal terminus of the interior ribs.

B22. The assembly of embodiment B20 or B21, wherein the region, or the portion of the region, of the interior surface, is an axially-disposed continuous, uninterrupted surface.

B23. The assembly of any one of embodiments B20-B22, wherein:

the region, or the portion of the region, of the interior surface, is bounded by an adjacent axially-disposed proximal surface and an adjacent axially-disposed distal surface; and the adjacent axially-disposed proximal surface and the adjacent axially-disposed distal surface do not contact the exterior surface of the dispenser.

B24. The assembly of any one of embodiments B20-B23, wherein the region, or the portion of the region, of the interior surface, is defined by a proximal perimeter located at or adjacent to the flange distal perimeter.

B25. The assembly of any one of embodiments B20-B24, wherein:

the portion of the region of the interior surface is a continuous surface defined by an axial distance of about 0.005 inches or greater; and the axial distance is the same as or less than the axial distance between (i) the interior rib proximal terminus and (ii) the flange distal perimeter.

C1. A method for manufacturing a pipette tip, comprising:

dispensing a molten polymer into a cavity of a mold configured to mold a pipette tip of any one of embodiments A1-A61, permitting the polymer in the cavity to cool, and releasing the formed pipette tip from the mold after cooling.

C2. The method of embodiment C1, wherein the mold comprises a metal.

C3. The method of embodiment C2, wherein the mold is manufactured from a metal.

C4. The method of embodiment C2 or C3, wherein the metal is chosen from aluminum, zinc, steel and a steel alloy.

C5. The method of any one of embodiments C1 to C4, wherein the polymer is chosen from low density polyethylene (LDPE), high-density polyethylene (HDPE), polypropylene (PP), high-impact polystyrene (HIPS), polyvinyl chloride (PVC), polyethylene terephthalate (PET), amorphous polyethylene terephthalate (APET), polycarbonate (PC), polyethylene (PE), or combination thereof.

C5.1. The method of any one of embodiments C1 to C4, which does not include insert molding a filter into the pipette tip.

C6. A mold configured to form a pipette tip of any one of embodiments A1-A61 by a molding process.

C7. The mold of embodiment C6, wherein the mold comprises a metal.

C8. The mold of embodiment C7, wherein the mold is manufactured from a metal.

C9. The mold of embodiment C7 or C8, wherein the metal is chosen from aluminum, zinc, steel and a steel alloy.

C10. The mold of any one of embodiments C6-C9, wherein the molding process is an injection molding process.

D1. A method for using a pipette tip of any one of embodiments A1-A61, comprising:

inserting a fluid dispenser member into a pipette tip of any one of embodiments A1-A61, and receiving fluid into the pipette tip optionally via air displacement.

D2. The method of embodiment D1, comprising dispensing the fluid from the pipette tip optionally via air displacement.

D3. The method of embodiment D1 or D2, comprising ejecting the pipette tip from the fluid dispenser member.

E1. A method of loading a filter into a pipette tip of any one of embodiments A1-A61, comprising:

disposing a filter at the proximal terminus of a pipette tip of any one of embodiments A1-A61; and applying a force to the proximal surface of the filter, wherein:

the force is applied in a direction parallel to the longitudinal axis, the distal surface of the filter contacts and passes over the proximal surface of the interior ribs, and the force is applied until the proximal surface of the filter is disposed at a position distal to the distal terminus of each of the interior ribs.

E2. The method of embodiment E1, wherein the force is applied by a press device.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the disclosed technology. Although the disclosed technology has been described in substantial detail with reference to one or more specific embodiments, those of ordinary skill in the art will recognize that changes may be made to the embodiments specifically disclosed in this application, yet these modifications and improvements are within the scope and spirit of the disclosed technology.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the invention claimed. The term "a" or "an" can refer to one of or a plurality of the elements it modifies (e.g., "a pipette tip" can mean one or more pipette tips) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" refers to about 1, about 2 and about 3). For example, a weight of "about 100 grams" can include weights between 90 grams and 110 grams. Further, when a listing of values is described herein (e.g., about 50%, 60%, 70%, 80%, 85% or 86%) the listing includes all intermediate and fractional values thereof (e.g., 54%, 85.4%). Thus, it should be understood that although the technology has been specifically disclosed by representative embodiments and optional features, modification and variation of the concepts herein disclosed may be resorted to by those skilled in the art, and such modifications and variations are considered within the scope of this technology.

Certain embodiments of the technology are set forth in the claims that follow.

What is claimed is:

1. A pipette tip, comprising a proximal opening, a distal opening, a proximal region, a distal region, a proximal terminus, an exterior surface, an interior surface, and a plurality of interior ribs, wherein:

each interior rib of the plurality of interior ribs is axially disposed on the interior surface of the pipette tip in the proximal region;

the interior ribs of the plurality of interior ribs are circumferentially distributed around the interior surface of the pipette tip;

each interior rib of the plurality of interior ribs comprises a proximal surface, an adjoining axial surface facing the pipette tip interior, a proximal terminus and a distal terminus;

a transition between the proximal surface and the axial surface is a beveled transition;

the proximal surface of each of the interior ribs is disposed at an angle a between 10 degrees and 80 degrees, wherein angle a is relative to a virtual longitudinal axis through the center of the pipette tip interior and a virtual axis collinear with the interior rib proximal surface; and a region of the interior surface of the pipette tip between the pipette tip proximal opening and the proximal terminus of each of the interior ribs is a sealing zone and the proximal surface of each of the interior ribs is disposed below the sealing zone.

2. The pipette tip of claim 1, wherein:

each of the interior ribs comprises a proximal terminus, and a region of the interior surface of the pipette tip between the pipette tip proximal opening and the proximal terminus of each of the interior ribs comprises no annular protrusion.

3. The pipette tip of claim 2, wherein the region of the interior surface of the pipette tip between the pipette tip proximal opening and the proximal terminus of each of the interior ribs comprises no protrusion.

4. The pipette tip of claim 3, wherein the region of the interior surface of the pipette tip between the pipette tip proximal opening and the proximal terminus of each of the interior ribs is smooth.

5. The pipette tip of claim 3, wherein:

the pipette tip comprises a frustum-shaped cavity within the interior of the proximal region, and the frustum-shaped cavity is smooth with the exception of the interior ribs.

6. The pipette tip of claim 1, wherein:

each of the interior ribs comprises a distal terminus;

the pipette tip comprises a filter comprising a proximal surface and a distal surface; and the proximal surface of the filter is disposed at or is distally spaced from the distal terminus of the each of the interior ribs.

7. The pipette tip of claim 6, wherein the filter is a plug filter.

8. The pipette tip of claim 1, wherein the proximal region comprises a distal terminus, the distal region comprises a proximal terminus and the distal terminus of the proximal region protrudes as a shoulder from the adjoining proximal terminus of the distal region.

9. The pipette tip of claim 1, comprising a plurality of exterior ribs, wherein:

each exterior rib of the plurality of exterior ribs is axially disposed on the exterior surface of the pipette tip;

the exterior ribs of the plurality of exterior ribs are circumferentially distributed around the exterior surface of the pipette tip;

each exterior rib of the plurality of exterior ribs comprises a distal terminus; and the distal terminus of each of the exterior ribs protrudes from the exterior surface of the pipette tip at a distal terminus of the proximal region.

10. The pipette tip of claim 1, comprising a flange and a flange distal perimeter.

11. The pipette tip of claim 10, comprising a plurality of exterior ribs, wherein:

each exterior rib comprises a proximal terminus, and the proximal terminus of each exterior rib is in connection with the flange distal perimeter.

12. The pipette tip of claim 1, wherein:

the interior surface of the pipette tip comprises a first interior wall section in the proximal region that includes a proximal end, a distal end and a continuously tapered interior wall surface having a first angle relative to the longitudinal axis, the interior surface of the pipette tip comprises a second interior wall section in the proximal region that includes a proximal end, a distal end and a continuously tapered interior wall surface having a second angle relative to the longitudinal axis, each of the first interior wall section and the second interior wall section tapers from the proximal end to the distal end of the interior wall section, and the second angle is greater than the first angle.

13. The pipette tip of claim 12, wherein:

each interior rib comprises a distal terminus, and at least a portion of the distal terminus of each interior rib is in connection with the second interior wall section.

14. The pipette tip of claim 1, wherein the thickness between the exterior surface and the interior surface, and disposed between the proximal terminus of the pipette tip to the proximal terminus of each of the interior ribs, is about 0.005 inches to about 0.015 inches.

15. The pipette tip of claim 1, wherein the pipette tip comprises a polymer or is manufactured from a polymer.

16. The pipette tip of claim 15, wherein the polymer is chosen from low density polyethylene (LDPE), high-density polyethylene (HDPE), polypropylene (PP), high-impact polystyrene (HIPS), polyvinyl chloride (PVC), polyethylene terephthalate (PET), amorphous polyethylene terephthalate (APET), polycarbonate (PC), polyethylene (PE), or combination thereof.

17. The pipette tip of claim 1, wherein:

a distal region wall thickness tapers from (a) a point at or between (i) about a junction of the proximal region and the distal region to (ii) about one-quarter of the axial distance from a terminus of the distal region to the junction, to (b) the distal region terminus, and the wall thickness at the distal region terminus is about 0.0040 inches to about 0.0055 inches.

18. The pipette tip of claim 1, wherein the interior surface of the pipette tip between the proximal terminus of the pipette tip and the distal terminus of the interior ribs does not include an annular protrusion.

19. An assembly comprising a pipette tip of claim 1 and a fluid dispenser, wherein:

the fluid dispenser comprises a nozzle member, nozzle member distal terminus, and a nozzle exterior wall;

a portion of the nozzle member is inserted within the proximal portion of the pipette tip;

a portion of the nozzle exterior wall is in contact with a portion of the interior wall of the pipette tip; and the nozzle member distal terminus is in contact with the proximal terminus of the interior ribs of the pipette tip.

20. An assembly comprising a pipette tip tray and an array of pipette tips, wherein:

the tray comprises a base and a pipette tip receptacle plate in association with the base;

the plate comprises a proximal surface, a distal surface and an array of bores each traversing the proximal surface to the distal surface of the plate;

each pipette tip of the array of pipette tips is a pipette tip of claim 1; and each pipette tip of the array of pipette tips is disposed in a corresponding bore of the array of bores in the plate.

21. The assembly of claim 20, comprising a sheet, wherein:

the sheet comprises a proximal surface, a distal surface and an array of holes;

each of the holes of the sheet comprises an interior hole edge and each of the holes of the sheet has a diameter or an effective diameter;

each pipette tip of the array of pipette tips is disposed in a hole of the sheet; the hole edge of each of the holes of the array of holes of the sheet contacts an exterior surface of a corresponding pipette tip of the array of pipette tips disposed in the corresponding hole of the array of holes in the sheet;

the diameter or the effective diameter of each of the holes of the array of holes in the sheet is less than the outer diameter of the exterior surface of the corresponding pipette tip of the array of pipette tips in contact with the corresponding hole edge; and the distal surface of the sheet contacts the proximal surface of the pipette tip receptacle plate.

22. The assembly of claim 21, wherein the sheet retains the pipette tips of the array of pipette tips by an adhesion force greater than the force of gravity.

23. The pipette tip of claim 1, wherein the pipette tip is a unitary pipette tip.

24. The pipette tip of claim 1, each interior rib of the plurality of interior ribs further comprising a side surface, and wherein a transition between the proximal surface and side surface is a beveled transition.

* * * * *